US011781355B1

(12) United States Patent
Lammers

(10) Patent No.: US 11,781,355 B1
(45) Date of Patent: Oct. 10, 2023

(54) ROLLER ASSEMBLY WITH SIDE-ACCESSED ADJUSTMENT MECHANISM

(71) Applicant: Tracy Lammers, Sioux Falls, SD (US)

(72) Inventor: Tracy Lammers, Sioux Falls, SD (US)

( * ) Notice: Subject to any disclaimer, the term of this patent is extended or adjusted under 35 U.S.C. 154(b) by 0 days.

(21) Appl. No.: 18/196,013

(22) Filed: May 11, 2023

Related U.S. Application Data

(60) Provisional application No. 63/349,281, filed on Jun. 6, 2022.

(51) Int. Cl.
*E05D 15/16* (2006.01)
*E05D 15/06* (2006.01)

(52) U.S. Cl.
CPC ..... *E05D 15/0634* (2013.01); *E05D 15/0669* (2013.01); *E05Y 2201/688* (2013.01)

(58) Field of Classification Search
CPC ..... E05D 15/0634; E05D 15/0647; E05D 15/0669; E05D 15/0682; E05Y 2201/10; E05Y 2201/638; E05Y 2201/688; E05Y 2900/132; E05Y 2800/268; E05Y 2800/29
See application file for complete search history.

(56) References Cited

U.S. PATENT DOCUMENTS 3,237,238 A * 3/1966 Anderson ..... E05D 15/0669 16/105
4,194,266 A 3/1980 Natzel
8,522,398 B2 * 9/2013 Haab ..... E05D 15/0634 16/105
10,738,521 B2 8/2020 Hamilton
2005/0012816 A1 * 1/2005 Becken ..... E05D 15/0665 348/107
2007/0017065 A1 * 1/2007 Hutnik ..... E05D 15/0669 16/91
2014/0150209 A1 * 6/2014 Tidwell ..... E05D 15/0669 16/100
2014/0310913 A1 * 10/2014 Horwood ..... E05D 15/0669 16/100
2018/0058122 A1 * 3/2018 Lang ..... E06B 3/46
2021/0131157 A1 5/2021 Minter
(Continued)

FOREIGN PATENT DOCUMENTS

CN 203729750 U * 7/2014
CN 204531823 U * 8/2015
CN 205224907 U * 5/2016
(Continued)

*Primary Examiner* — Chuck Y Mah
(74) *Attorney, Agent, or Firm* — Jeffrey A. Proehl; Woods, Fuller, Shultz & Smith, PC

(57) ABSTRACT

An adjustable roller support mechanism for mounting on a panel positionable with respect to an opening in a building structure to support the panel on the structure. The mechanism may comprise an adjustment assembly configured to be mounted on the panel. The adjustment assembly may comprise a case defining an interior and at least one roller for contacting the opening rotatably mounted on the case. The mechanism may further comprise an adjustment element configured to contact the panel at a contact surface and further configured to adjustably move the case and the at least one roller mounted thereon with respect to the contact surface to adjust the position of the at least one roller with respect to the panel when the adjustment assembly is mounted on the panel.

16 Claims, 26 Drawing Sheets

(56) References Cited

U.S. PATENT DOCUMENTS

| | | | | |
|---|---|---|---|---|
| 2022/0154504 | A1* | 5/2022 | Minter | E05D 15/0669 |
| 2023/0175298 | A1* | 6/2023 | Scorcia | E05D 15/0665 16/91 |

FOREIGN PATENT DOCUMENTS

| | | | | |
|---|---|---|---|---|
| CN | 206448676 | U | * | 8/2017 |
| CN | 206513175 | U | * | 9/2017 |
| CN | 206844910 | U | * | 1/2018 |
| CN | 207934677 | U | * | 10/2018 |
| JP | 2003214012 | A | * | 7/2003 |
| KR | 20190001469 | U | * | 6/2019 |
| KR | 102160790 | B1 | * | 9/2020 |

* cited by examiner

ROLLER ASSEMBLY WITH SIDE-ACCESSED ADJUSTMENT MECHANISM

REFERENCE TO RELATED APPLICATIONS

This application claims the priority benefit of U.S. Provisional Patent Application No. 63/349,281, filed Jun. 6, 2022, the entirety of the disclosure of which is hereby incorporated by reference.

BACKGROUND

Field

The present disclosure relates to closures for openings in building structures, such as doors and windows, and more particularly pertains to a new roller assembly with side-accessed adjustment mechanism for adjusting the position characteristics of a door or window panel in the opening in a building structure, such as the vertical position of the panel in the opening, and the adjustment mechanism may provide significant advantage in enabling position adjustments to be made while the load of the panel is imposed upon the roller assembly and adjustment mechanism.

SUMMARY

In one aspect, an adjustable support mechanism for mounting on a panel positionable with respect to an opening in a building structure to support the panel on the structure. The roller support mechanism may comprise an adjustment assembly configured to be mounted on the panel, and the adjustment assembly may comprise a case defining an interior and at least one roller for contacting the opening rotatably mounted on the case. The adjustment assembly may further comprise an adjustment element configured to contact the panel at a contact surface and further configured to adjustably move the case and the at least one roller mounted thereon with respect to the contact surface to adjust the position of the at least one roller with respect to the panel when the adjustment assembly is mounted on the panel.

In another aspect, the present disclosure relates to an adjustable roller support mechanism positionable in a roller cavity of a sliding glazed panel. The roller support mechanism may comprise a housing defining an interior space and including an upper bearing structure for bearing against a portion of the panel when mounted on the panel. The mechanism may further comprise a roller carriage positioned in the interior space of the housing and being movable with respect to the housing, and at least one roller mounted on the roller carriage in a manner permitting rotation of the rollers with respect to the roller carriage. The support mechanism may also comprise an adjustment assembly configured to adjust a position of the roller carriage with respect to the housing in the interior space of the housing. The adjustment assembly may comprise a case mounted on the housing such that the case and the housing move as a unit, and an adjustment element movable with respect to the case to bear against the roller carriage to move the roller carriage and the at least one roller mounted thereon with respect to the housing.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
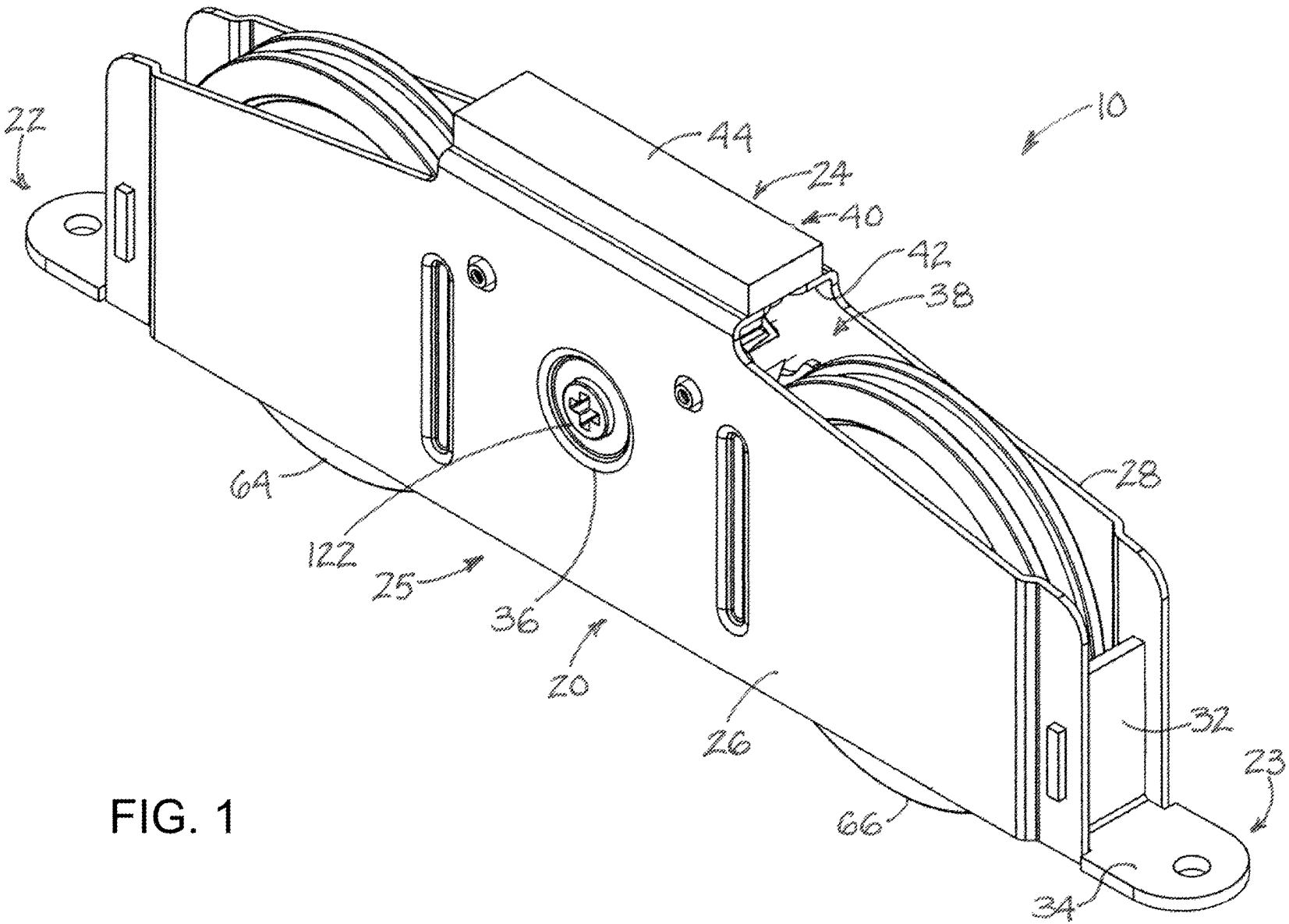
FIG. 1 is a schematic perspective view of an illustrative embodiment of a new roller support mechanism with side-accessed adjustment, according to the present disclosure.
Figure 2:
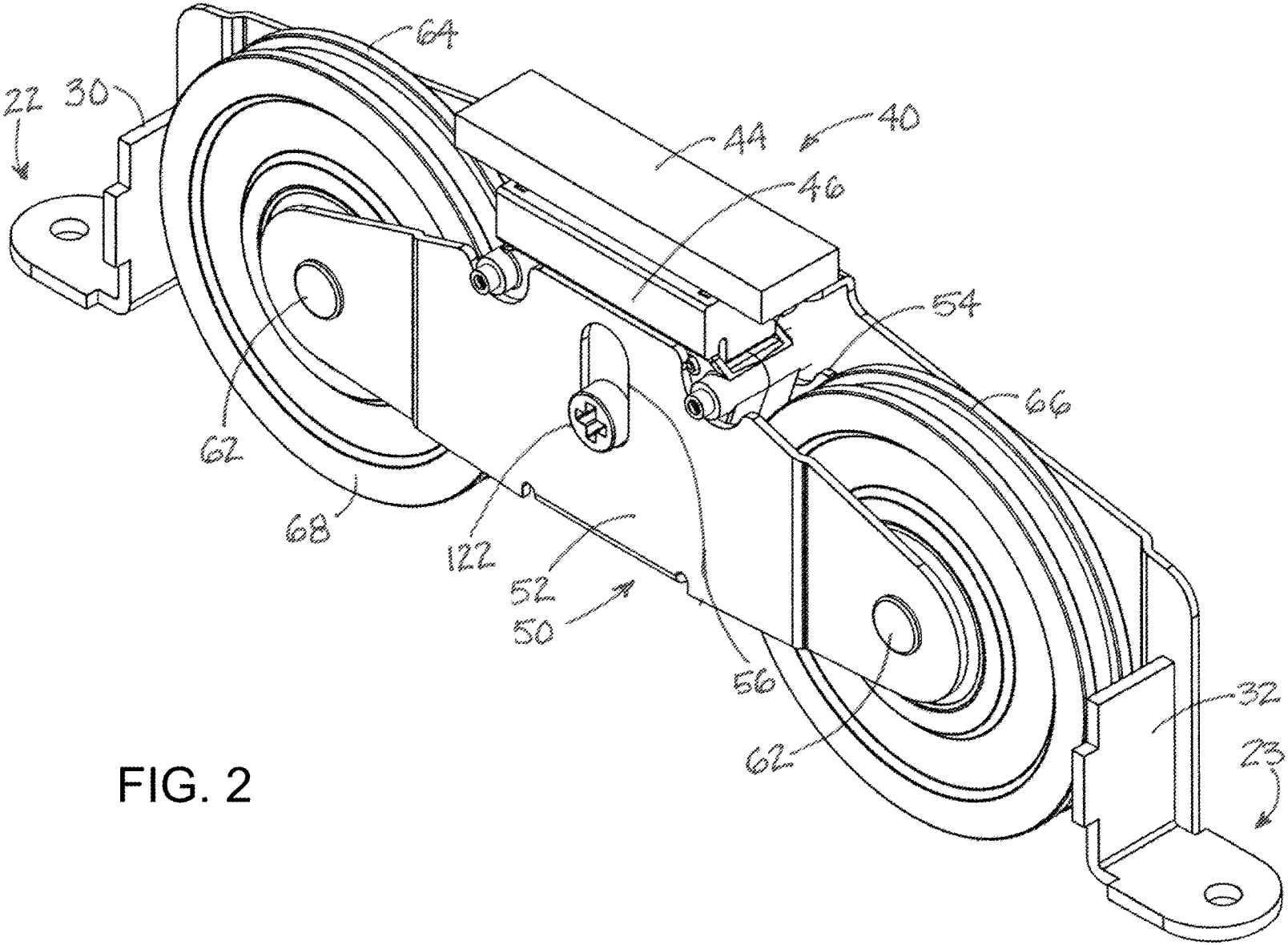
FIG. 2 is a schematic perspective view of a partially disassembled roller support mechanism having a side wall of the housing removed to reveal detail of the mechanism, according to an illustrative embodiment.
Figure 3:
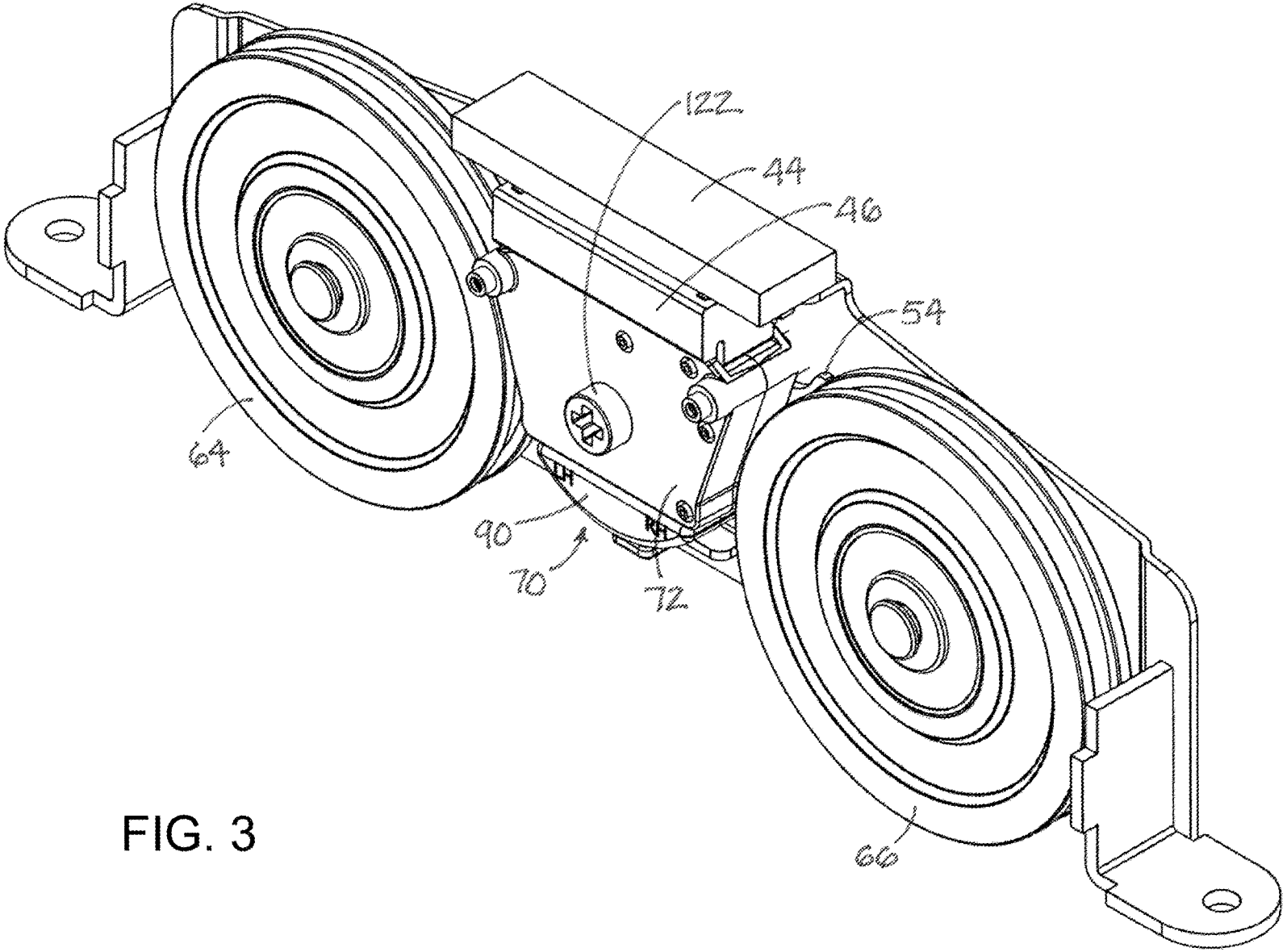
FIG. 3 is a schematic perspective view of a partially disassembled roller support mechanism further having a carriage plate of the roller carriage removed to reveal detail of the mechanism, according to an illustrative embodiment.
Figure 4:
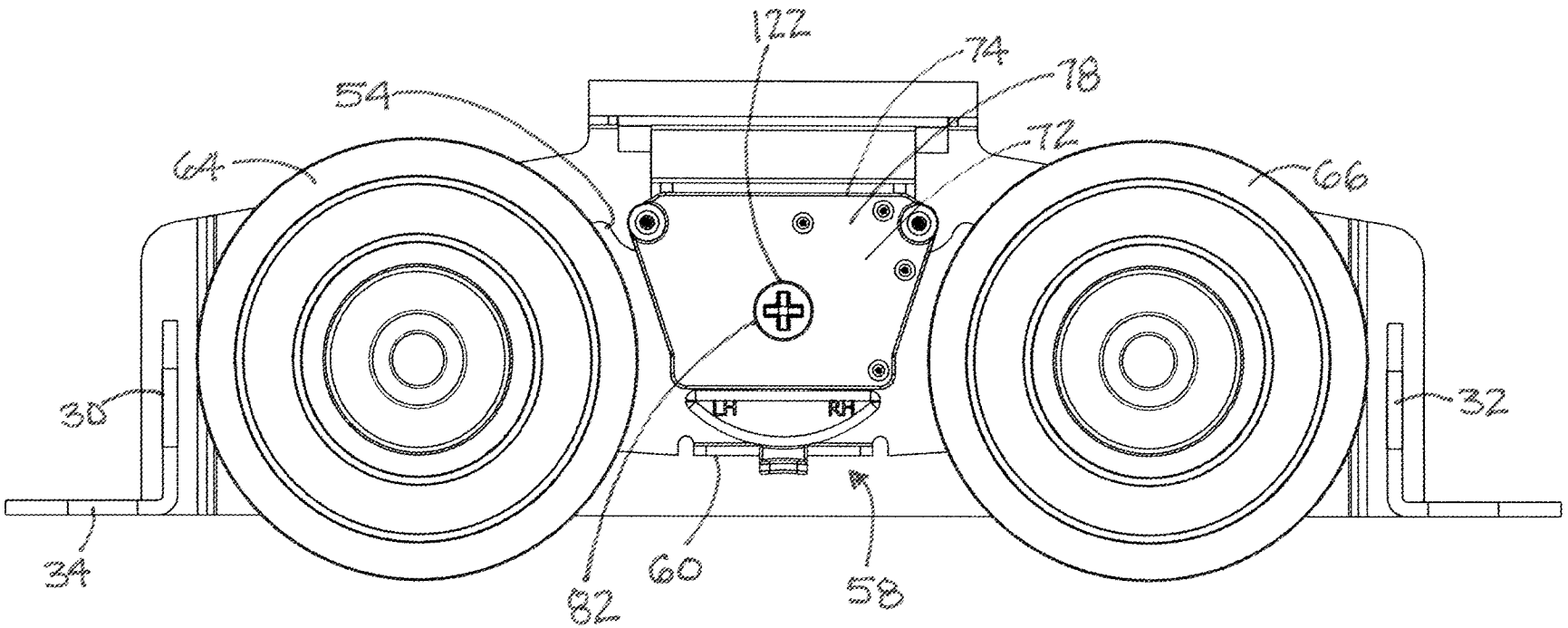
FIG. 4 is a schematic side view of a partially disassembled roller support mechanism further having a carriage plate of the roller carriage removed to reveal detail of the mechanism, according to an illustrative embodiment.
Figure 5:
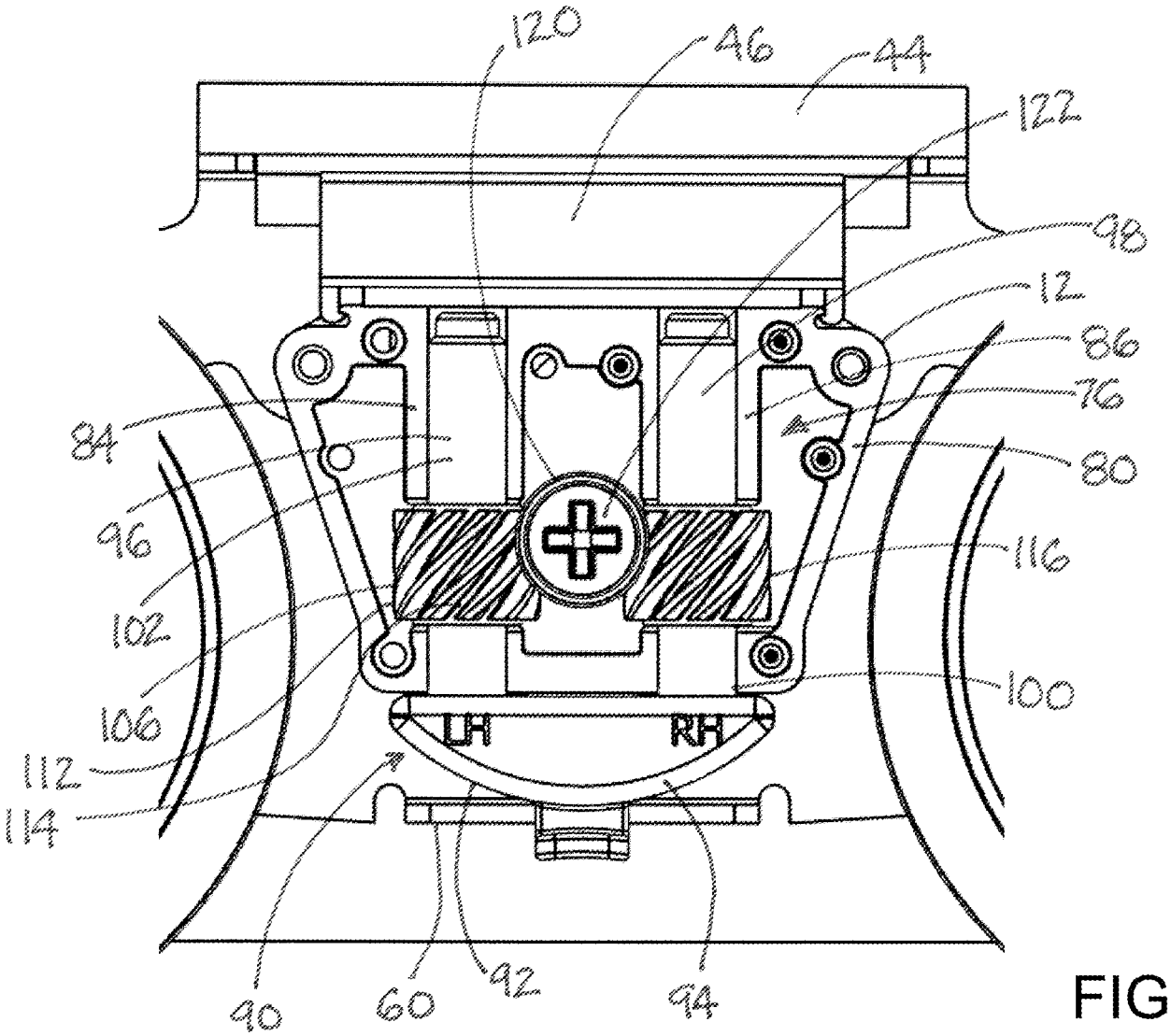
FIG. 5 is a schematic side view of a portion of a partially disassembled roller support mechanism further having a shell portion of the case of the adjustment assembly removed to reveal detail of the mechanism, according to an illustrative embodiment.
Figure 6:
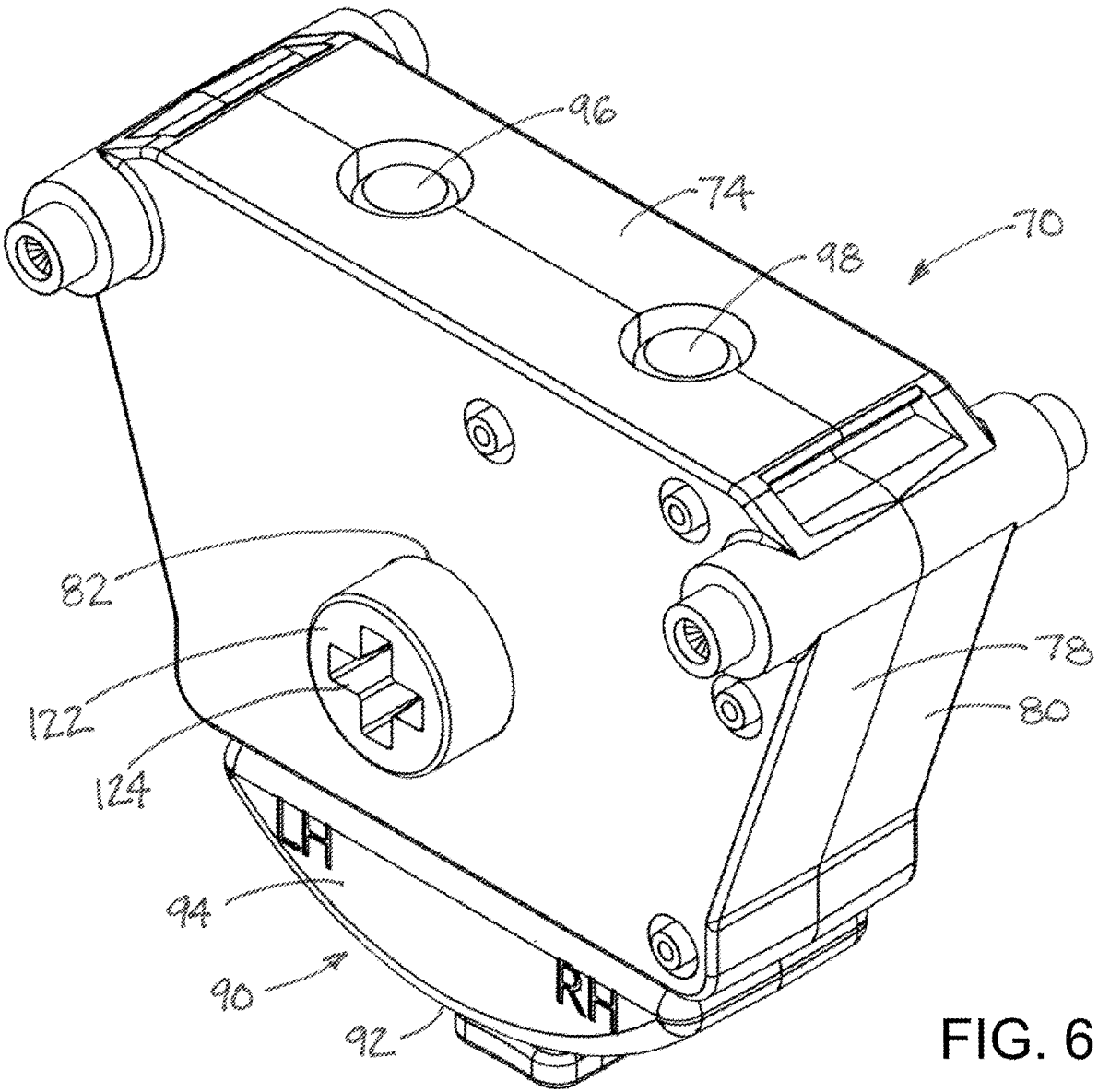
FIG. 6 is a schematic perspective view of the adjustment assembly isolated from other elements of the system, according to an illustrative embodiment.
Figure 7:
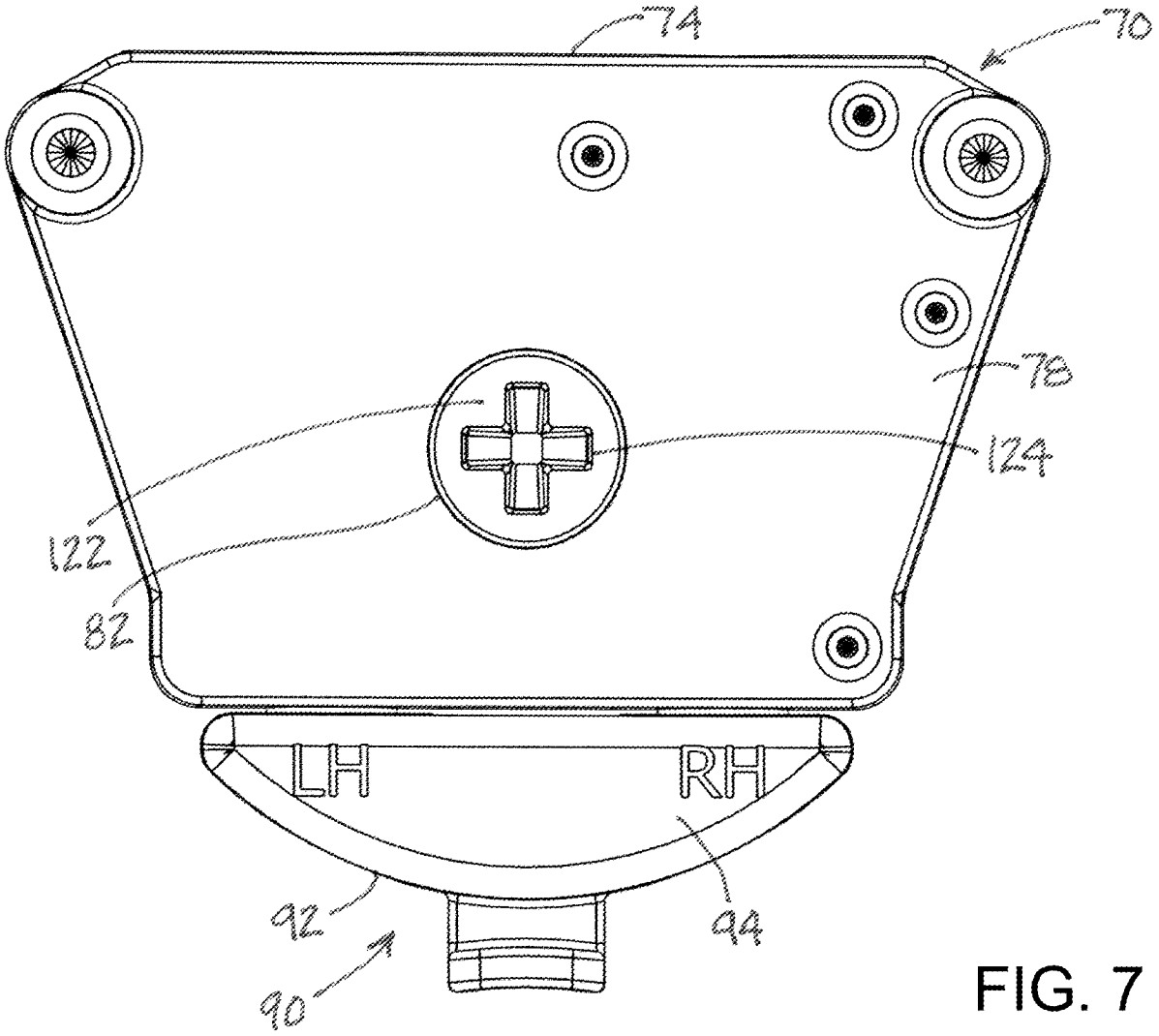
FIG. 7 is a schematic front view of the adjustment assembly isolated from other elements of the system, according to an illustrative embodiment.
Figure 8:
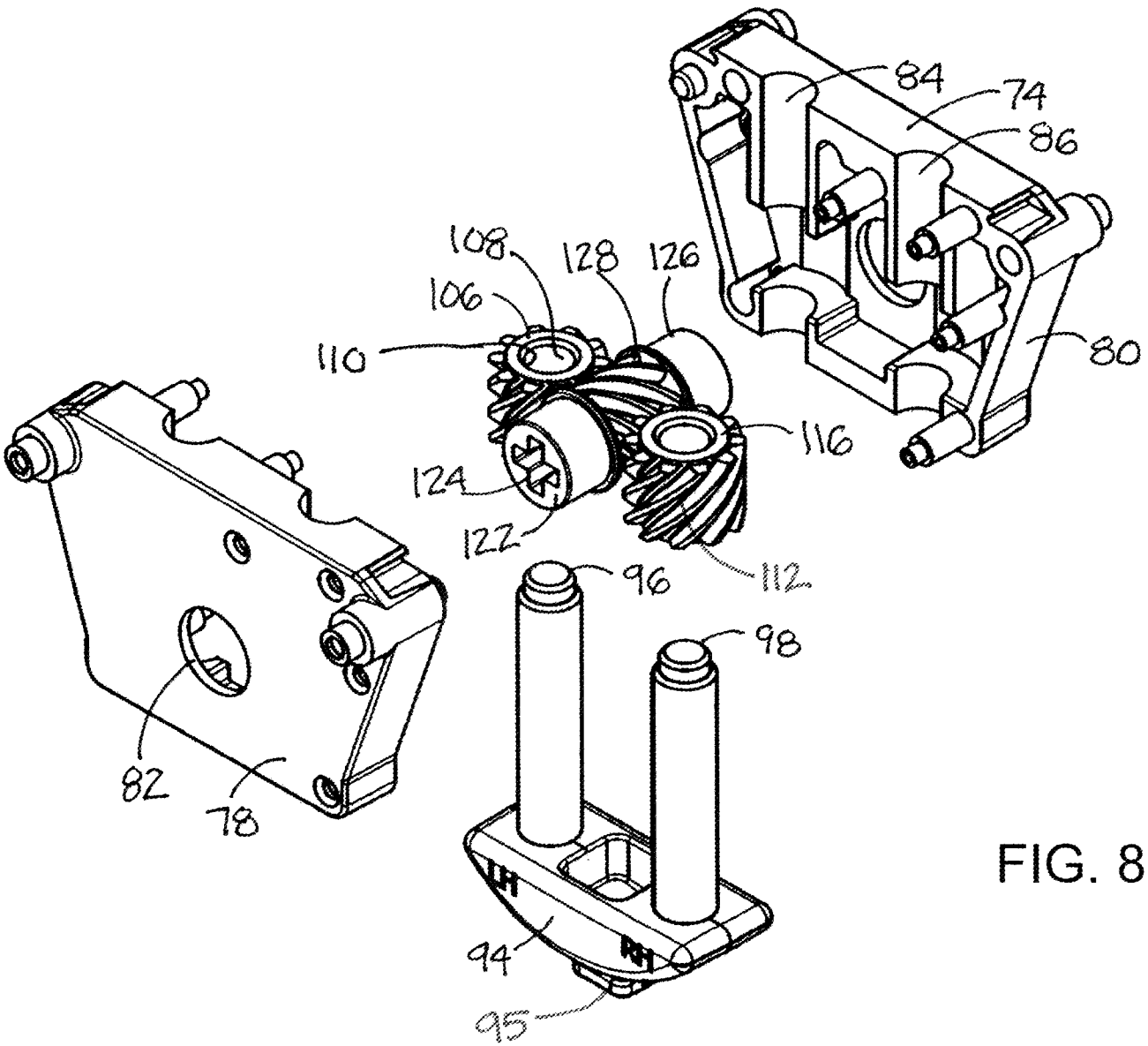
FIG. 8 is a schematic exploded perspective view of the adjustment assembly isolated from other elements of the system, according to an illustrative embodiment.
Figure 9:
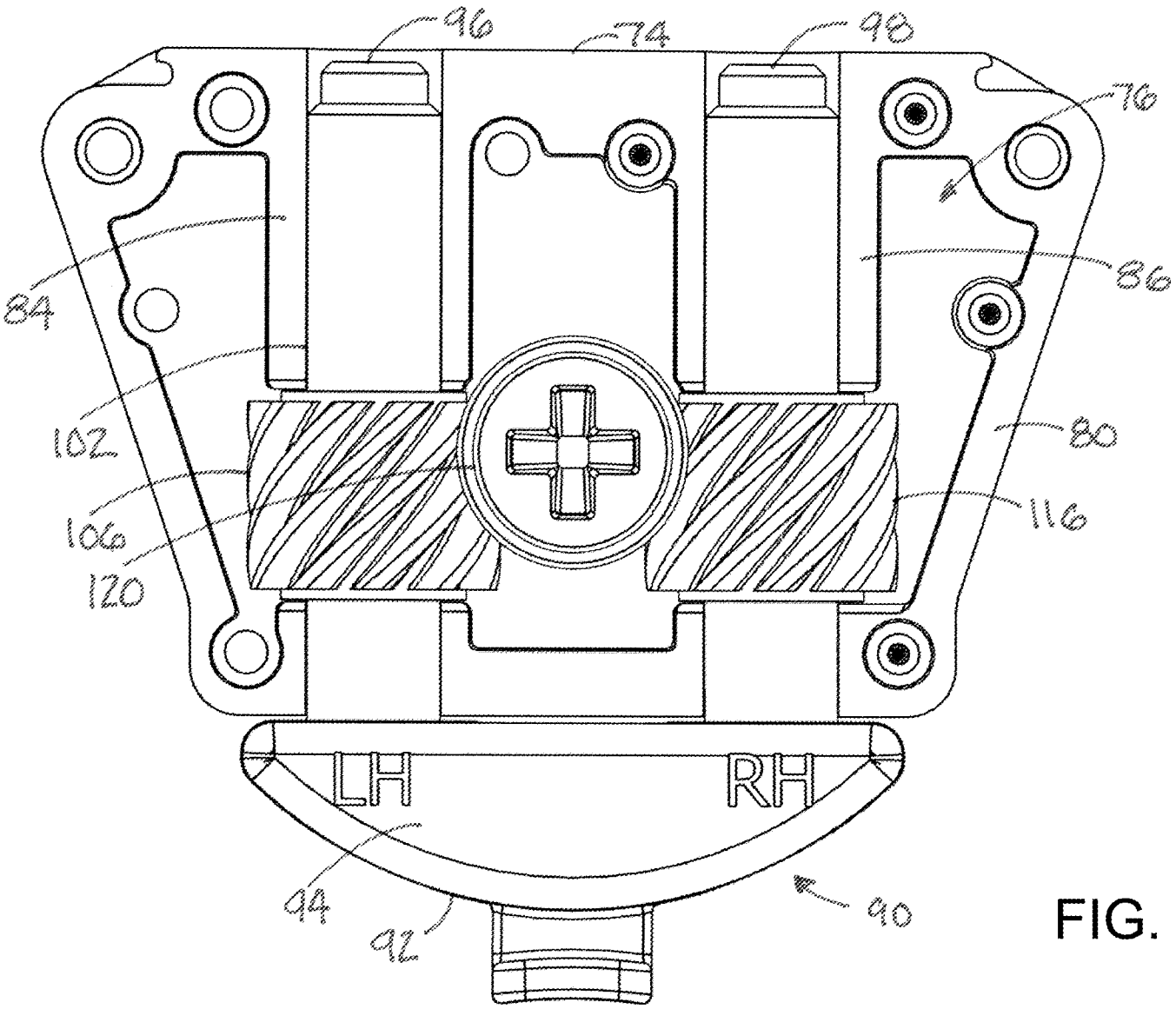
FIG. 9 is a schematic front view of the adjustment assembly isolated from other elements of the system and having a shell portion of the case of the adjustment assembly removed to reveal detail, according to an illustrative embodiment.
Figure 10:
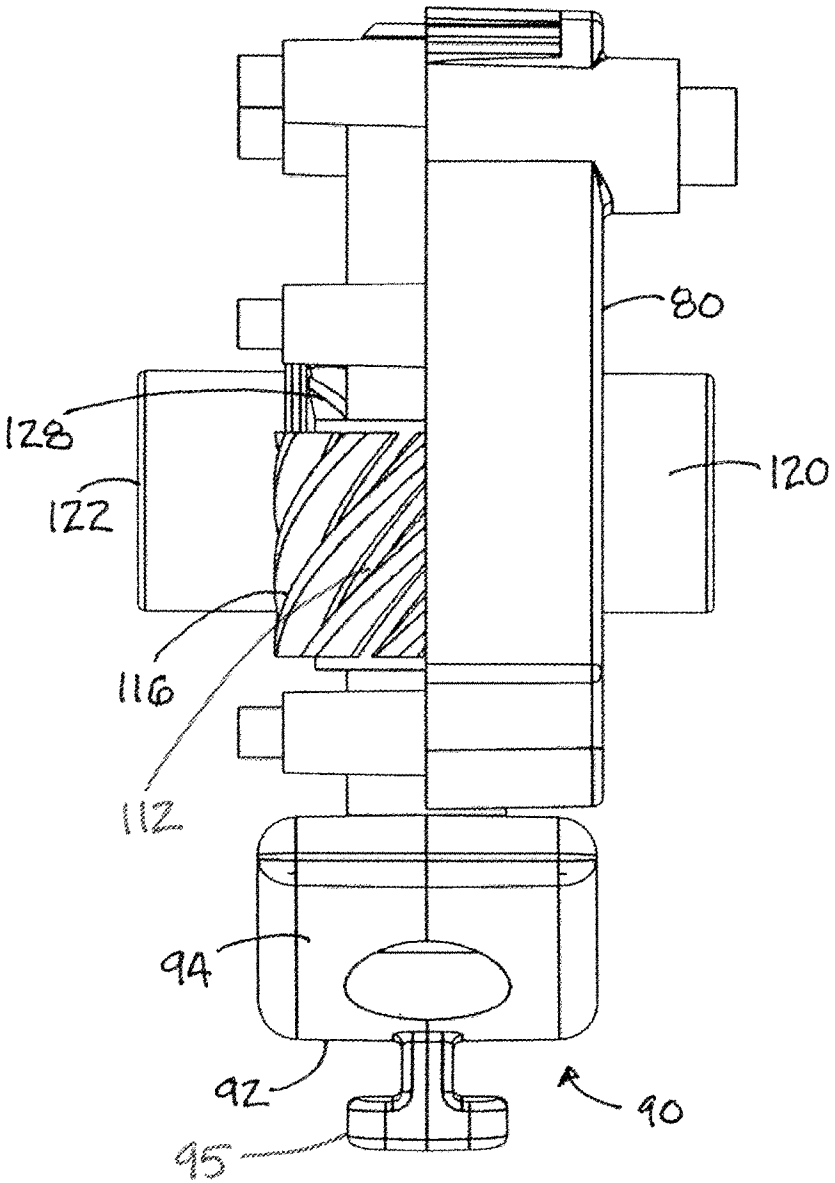
FIG. 10 is a schematic side view of the adjustment assembly isolated from other elements of the system and having a shell portion of the case of the adjustment assembly removed to reveal detail, according to an illustrative embodiment.

With reference now to the drawings, and in particular to FIGS. 1 through 26 thereof, a new roller assembly with side-accessed adjustment mechanism embodying the principles and concepts of the disclosed subject matter will be described.

Roller assemblies are useful for supporting movable opening closures such as doors and windows in a building structure which engages in some degree of translational motion, such as by sliding or folding with respect to the opening in the structure. For proper fit and operation of the door in the door or window opening, adjustment of the protrusion of the supporting rollers from the door or window panel is highly useful to adapt to dimensional variations caused by manufacturing and installation conditions, as well as wear that may occur during years of use. Access for adjustment may be provided through the end edge of the panel, or one of the broader faces of the panel, and various configurations of devices have been devised to accomplish that purpose. The applicant has recognized that precise adjustability of the roller position is advantageous, but that the precise adjustment is complicated by the relatively small space available in the door or window panel for the operating mechanism particularly in door panels of heavy weights which may impose weights of up to 500 hundred pounds or more per roller unit. For the most accurate adjustment of the roller position, the panel should be in position in the door or window opening, and as a result the adjustment of the roller position occurs while the rollers are "under load" and supporting the panel.

The applicant has recognized that existing approaches for adjusting the roller assemblies tend to be unsatisfactory for a number of reasons. In many previous approaches, adjustment of the roller assembly is not able to be performed when the full weight of the panel is rested upon the roller assembly, and thus requires that the panel be manually lifted up to remove some or all of the load from the roller assembly while adjustment is being performed. Other roller adjustment approaches have utilized camming structures with cams that have discrete notches formed on the exterior of one or more of the cams and as a result limit adjustment to a fixed number of discrete positions, and those positions may or may not provide the most suitable adjustment position for roller assembly on a particular door panel. Moreover, the usage of notches in the adjustment mechanism tends to impose a rough or crude feel to the adjustment process as a result of the engaging element moving or slipping from one notch to the next notch, particularly if adjustment occurs under some degree of loading of the roller assembly. Also, in some previously employed roller assembly adjustment designs, such as those that employ notches, the torque required to be applied to adjust the roller assembly may vary depending upon the current adjustment position in the full adjustment range. Further, known roller assembly adjustment approaches do not actively retract the rollers with respect to the panel, but instead rely upon an external application of force (e.g., manual retraction by the hand of the installer or imposition of the weight of the door or window) to the rollers to produce the actual retraction of the roller assembly. However, this approach may also allow portions of the roller assembly to freely extend from the panel at inopportune times, such as when the panel is being installed and the panel needs to be raised to a sufficient height above the door or window sill to permit the roller assembly to be correctly seated on the sill track rail. As a result, the panel may have to be raised above the sill track rail to a much greater degree than if the elements of the roller assembly were able to be maintained in a fully, or substantially fully, retracted position during the initial positioning of the panel in the door or window opening.

It will be appreciated from the present disclosure, the applicant has developed a new and unique adjustable roller support mechanism which in various configurations address some or all of these disadvantages in previous roller assembly adjustment mechanisms, and thus aspects of the adjustable roller support mechanism of the disclosure may permit adjustment under conditions where significant weight loads are imposed upon the mechanism, may permit substantially infinite adjustment within the range of adjustment which has a smooth character, may require substantially uniform torque application throughout the range of adjustment, and may actively retract the rollers for adjustment without requiring external intervention and without permitting inadvertent separation of parts of the adjustment mechanism from each other. Significantly, the advantages of the disclosure may be available in applications in which the door or window panel rests upon the roller support mechanism as well as applications in which the door or window panel is suspended by the roller support mechanism in the opening. Further, the advantages of the disclosure may also be available in applications in which the door or window panel rotates instead of or in addition to translating along the sill of the opening.

In some aspects, the disclosure relates to a sliding door assembly 1 for selectively closing an opening of a building structure that may form a point of entrance and egress from the interior of the building, such as a door way, or a window. The door assembly 1 typically relates to closures that move in a horizontal direction, such as in a sliding movement so as to be positioned over (e.g., closed), or not over (e.g. not closed), the opening in the building.

In illustrative embodiments, the sliding door assembly 1 may include a door panel 2 which is generally slab-shaped and oriented in a generally vertical plane, and may include a transparent, or substantially transparent, pane of glass or material of similar functionality. The door panel 2 may have a lower edge surface 3 which is oriented downwardly toward a threshold or sill of the opening. The door panel 2 may also have a first face surface 4 and a second face surface 5 forming broad faces of the panel 2. The door panel 2 defines at least one roller cavity 6 extending into the door panel from the lower edge surface 3, and typically the door panel 2 may have a pair of the roller cavities. The roller cavities may be spaced between a forward edge at the intersection of the lower edge surface and the front face surface 3 and a rearward edge at the intersection of the lower edge surface and the second face surface 5.

In some aspects, the disclosure relates to an adjustable roller support mechanism 10, alone or in combination with the door panel 2 of the door assembly. The roller support mechanism 10 may be positioned in the roller cavity 6 of the door panel, and plural support mechanisms may each be positioned in plural cavities. The roller support mechanism 10 may be elongated in shape in a longitudinal direction 12, and may have a lateral direction 14 which is oriented substantially perpendicular to the longitudinal direction.

In embodiments, the roller support mechanism 10 may comprise a housing 20. The housing 20 may be elongated with opposite ends 22, 23, and has a top 24 and a bottom 25. The bottom 25 of the housing 20 may be open, or substantially open. The housing 20 may include opposite side walls 26, 28 and opposite end walls 30, 32 that extend between the side walls. Each of the end walls 30, 32 may have a mounting tab 34 that extends from the respective end. At least one of the opposite side walls 26, 28 may have an adjustment clearance opening 36, and each of the side walls 26, 28 may have an opening. The housing 20 may define an interior space 38 between the opposite side walls 26, 28 and the opposite end walls 30, 32. The housing 20 may further include an upper bearing structure 40 which is positioned toward the top 24 of the housing, and may bear against a portion of the door panel in the roller cavity 6. In the illustrative embodiments, at least one of the side walls 26, 28 may form a portion of the upper bearing structure 40, and optionally both of the side walls may form a portion of the structure 40. At least one of the side walls 26, 28 (and optionally both walls) may have an upper tab 42 extending inwardly to form the upper bearing structure. In some embodiments, the housing 20 may include a primary bearing element 44 for bearing against a surface of the door panel forming the roller cavity 6 of the door panel. The primary bearing element 44 may rest on the bearing structure 40. In some embodiments, the housing 20 may also include a secondary bearing element 46 positioned below the bearing structure 40. In other embodiments, other bearing structure(s) may be utilized, or no bearing structure at all other than portions of the housing 20, such as the tabs 42.

The adjustable roller support mechanism 10 may include a roller carriage 50 positioned in the interior space 38 of the housing. The roller carriage 50 may be movable with respect to the housing in the space. The roller carriage 50 may be adjustably movable in at least the vertical direction with respect to the housing when the mechanism is mounted on a door panel.

Figure 22:
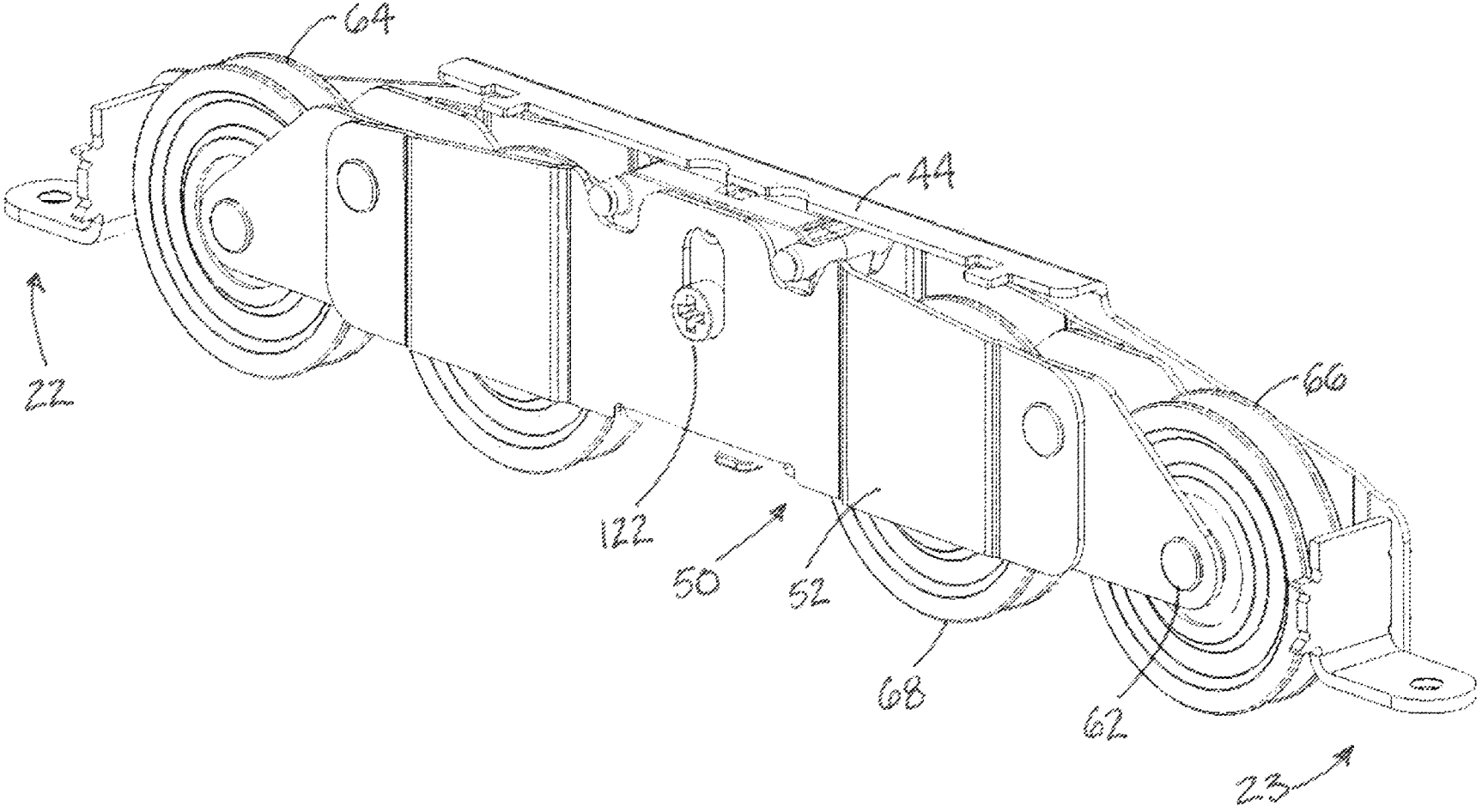
FIG. 22 is a schematic perspective view of a partially disassembled embodiment of the roller support mechanism having the side wall of the housing removed to reveal detail of the mechanism including four rollers, according to an illustrative embodiment.
Figure 23:
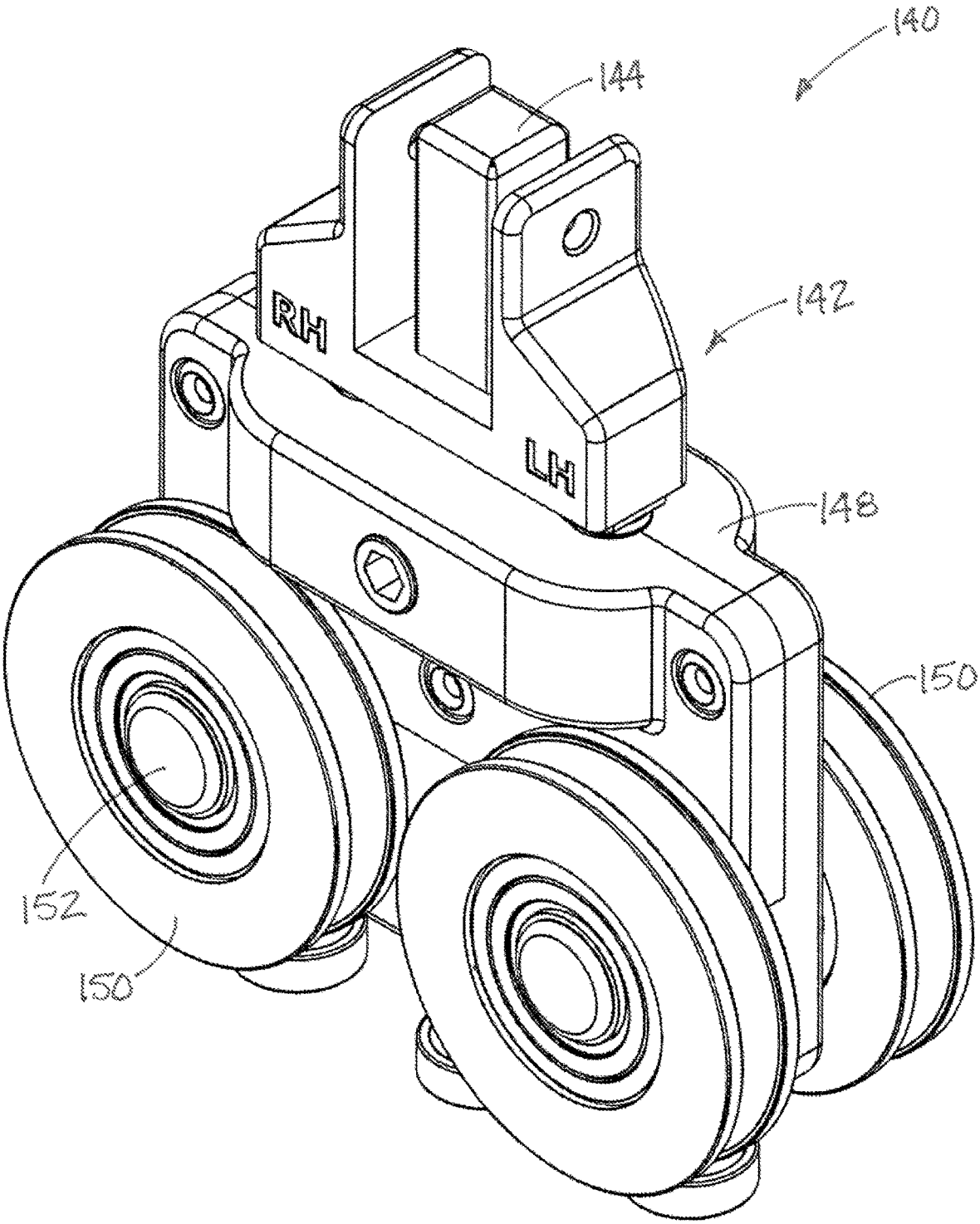
FIG. 23 is a schematic perspective view of an additional illustrative embodiment of the roller support mechanism of the disclosure.
Figure 24:
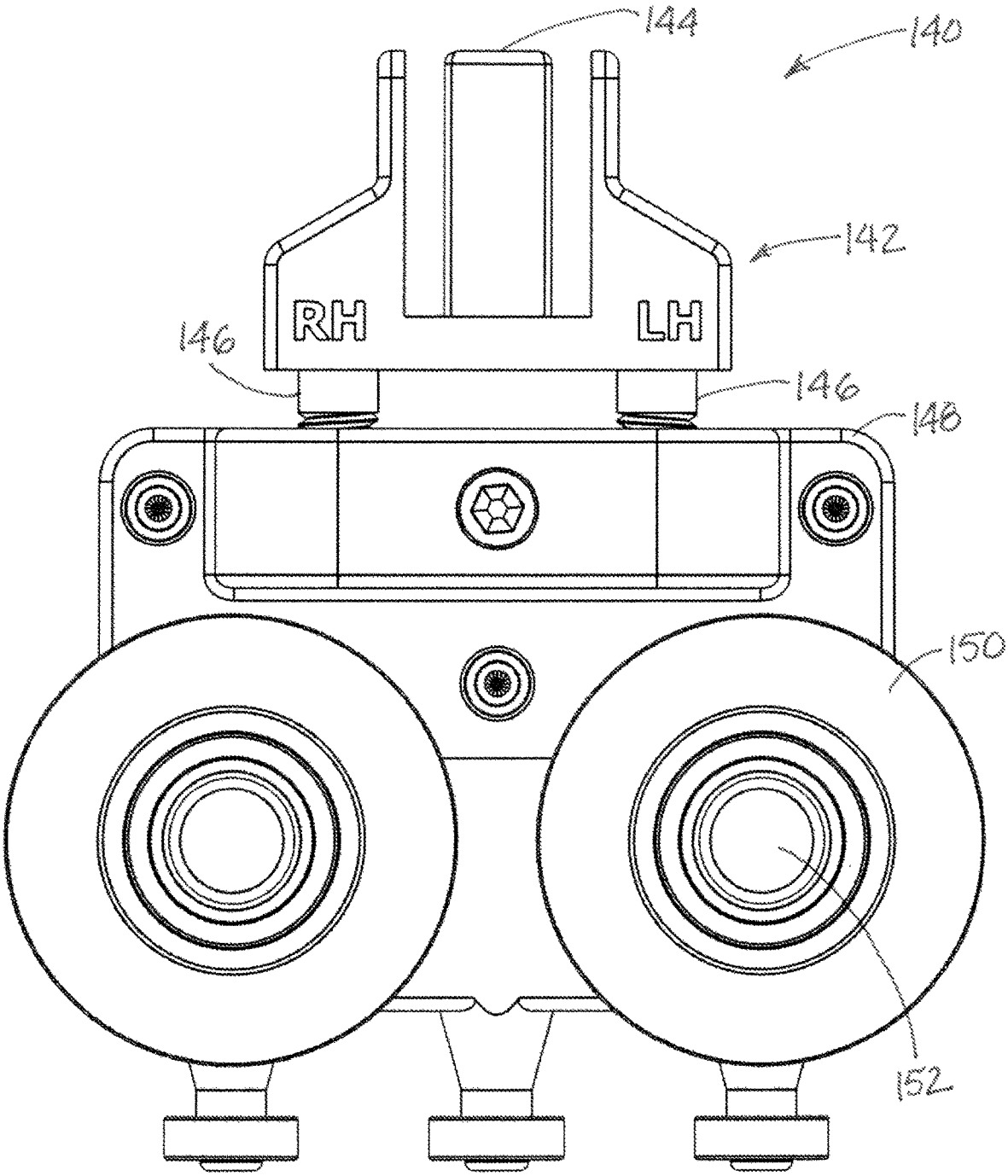
FIG. 24 is a schematic side view of the roller support mechanism shown in FIG. 23, according to an illustrative embodiment.
Figure 25:
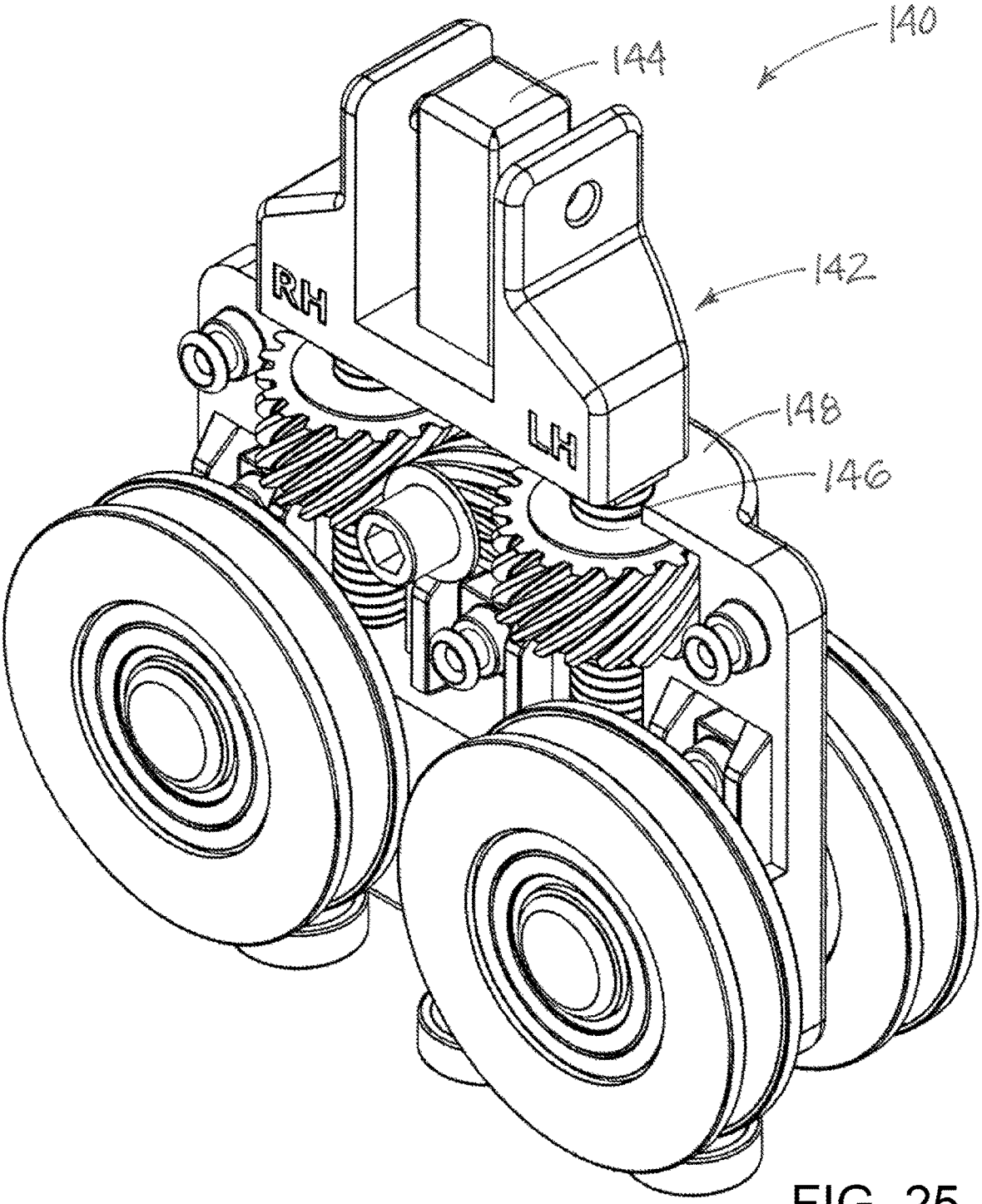
FIG. 25 is a schematic perspective view of the roller support mechanism shown in FIG. 23 with a shell portion of the case removed to reveal detail of the adjustment assembly, according to an illustrative embodiment.
Figure 26:
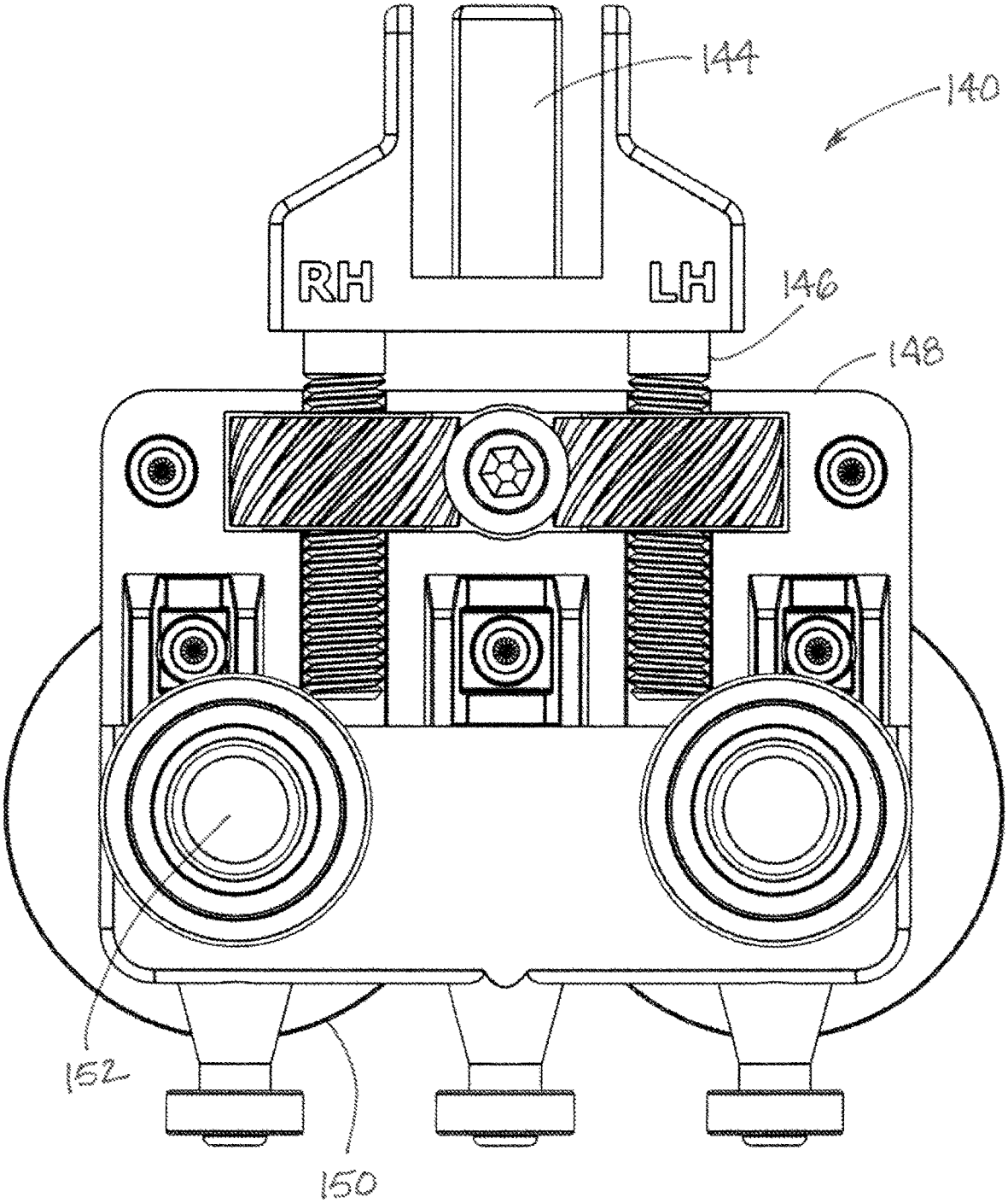
FIG. 26 is a schematic side view of the roller support mechanism shown in FIG. 23 with a shell portion of the case and a pair of the rollers removed to reveal detail of the adjustment assembly, according to an illustrative embodiment.

In greater detail, the roller carriage 50 may include a pair of carriage plates 52, 54, and at least one of the carriage plates may have an adjustment clearance slot 56. At least one of the carriage plates 52, 54 may have a lower bearing structure 58, and may comprise a lower tab 60 that extends laterally inwardly to form the lower bearing structure, and each of the carriage plates may have a lower tab. The roller carriage may include a pair of carriage axles 62 extending between and secured to the carriage plates 52, 54. A pair of rollers 64, 66 may be mounted on the roller carriage in a manner permitting rotation of the rollers with respect to the roller carriage, and the rollers may be positioned between the carriage plates 52, 54. It should be recognized that, while the illustrative embodiments and description generally relate to a roller support mechanism 10 having a pair of rollers, more or less than a pair of rollers may be utilized by extension of aspects of the roller carriage 50, such as is illustrated in FIG. 22.

The roller carriage 50 may be configured to position a lower portion 68 of the rollers through the open bottom 25 of the housing such that the rollers protrude or extend from the interior space of the housing. When the housing 20 is mounted on the door panel 2, such as in cavity 6, then the degree or extent of protrusion of the lower portion 68 from the housing and from the door panel may influence or control the vertical position of the door panel in the building structure opening being covered or partially covered by the panel 2.

Advantageously, the adjustable roller support mechanism 10 includes an adjustment assembly 70 which is configured to adjust a degree or extent of protrusion of the rollers 64, 66 from the mechanism 10, and may thus adjust the protrusion of the rollers from the lower edge surface 3 of the door panel when the mechanism 10 is installed on the door panel. The adjustment assembly 70 may adjust the position of the roller carriage 50 with respect to the housing 20, and may adjust the position of the roller carriage in the interior space 38 of the housing. The adjustment assembly 70 may be configured to bear on at least one of the bearing structures, either the upper bearing structure 40 or the lower bearing structure 58, or both. The adjustment assembly 70 may be positioned in the interior space 38 of the housing 20, and may be positioned between the carriage plates 52, 54.

The adjustment assembly 70 may further comprise a case 72 which may be mounted on the housing 20 in a manner such that the case and the housing move as a unit. Illustratively, the case 72 may have an upper contact surface 74 that may be positioned adjacent to the secondary bearing element 46 such that the upper contact surface 74 is able to bear against the secondary bearing element. In some implementations, the case 72 and the secondary bearing element 46 may include features structure that engage each other to resist separation of the case 72 and bearing element 46. In other embodiments, such as those in embodiments in which one or more of the bearing elements is omitted, the upper contact surface 74 of the case may directly or indirectly engage the upper tab or tabs 42 of the housing 20. The case 72 may define or enclose a case interior 76, or interior of the case.

The case 72 may be comprised of a pair of shell portions 78, 80 which may be connectable together to define the case interior 76. In some embodiments, the shell portions may generally mirror images of each other. At least one of the shell portions 78, 80 may have an adjustment clearance aperture 82. Each of the shell portions 78, 80 may include at least one sleeve surface 84, and in some embodiments each of the shell portions includes a pair of the sleeve surfaces 84, 86.

The adjustment assembly 70 may also comprise an adjustment element 90 which is movable with respect to the case 72. The adjustment element 90 may have a lower contact surface 92, and the lower contact surface may be positioned adjacent to the lower bearing structure 58 such that the lower contact structure is able to bear against the lower bearing structure 58. Illustratively, the adjustment element 90 includes a contact component, such as a contact bumper 94, and the contact bumper may form the lower contact surface 92. In some embodiments, an engagement feature may be formed on the contact bumper 94 of the adjustment element. The engagement feature 95 may be suitably configured or embodied to engage a structure of the roller carriage 50, such as, for example, the lower bearing structure 58, which may include one or more lower tabs 60 of the carriage plates 52, 54.

The adjustment element may also include at least one adjustment post 96, and may include a pair of the adjustment posts 96, 98. The adjustment post 96 has a lower end 100 joined with the contact bumper such that movement of the adjustment post is communicated to the contact component or bumper 94. In some embodiments, the one or more adjustment posts may be integrally formed with the contact bumper which may constrain the posts against rotation with respect to the contact bumper. The post or posts 96, 98 may have a peripheral surface 102, and at least a portion of the peripheral surface may have threads 104 formed thereon. Each adjustment post 96, 98 may be positioned adjacent to the sleeve surfaces 84, 86 of the shell portions 78, 80 to guide translational movement of the adjustment post when the adjustment element 90 moves with respect to the case 72.

Figure 12:
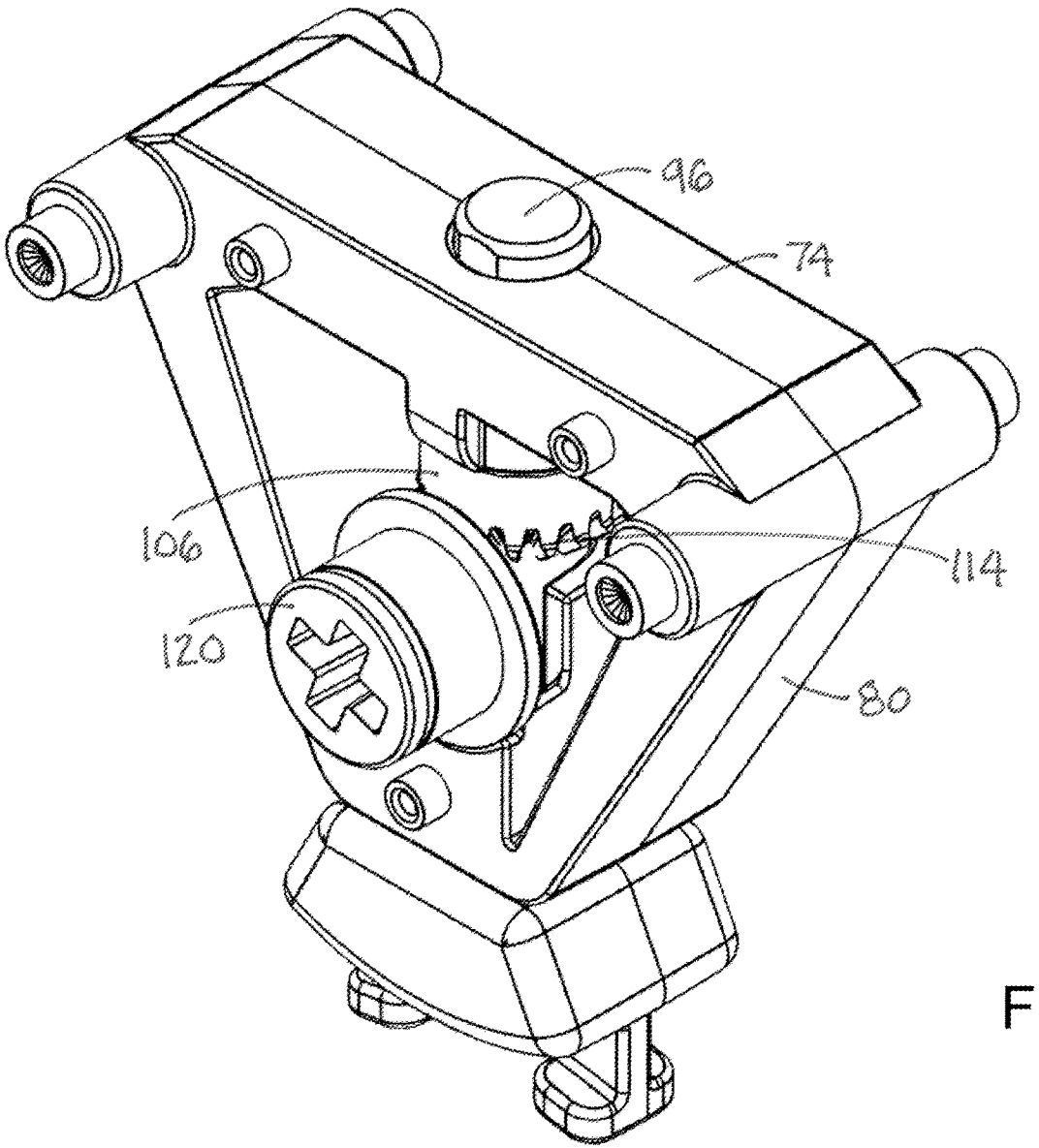
FIG. 12 is a schematic perspective view of the illustrative embodiment of FIG. 11 of the adjustment assembly isolated from other elements of the system, with a shell portion of the case of the adjustment assembly removed to reveal detail, according to an illustrative embodiment.
Figure 13:
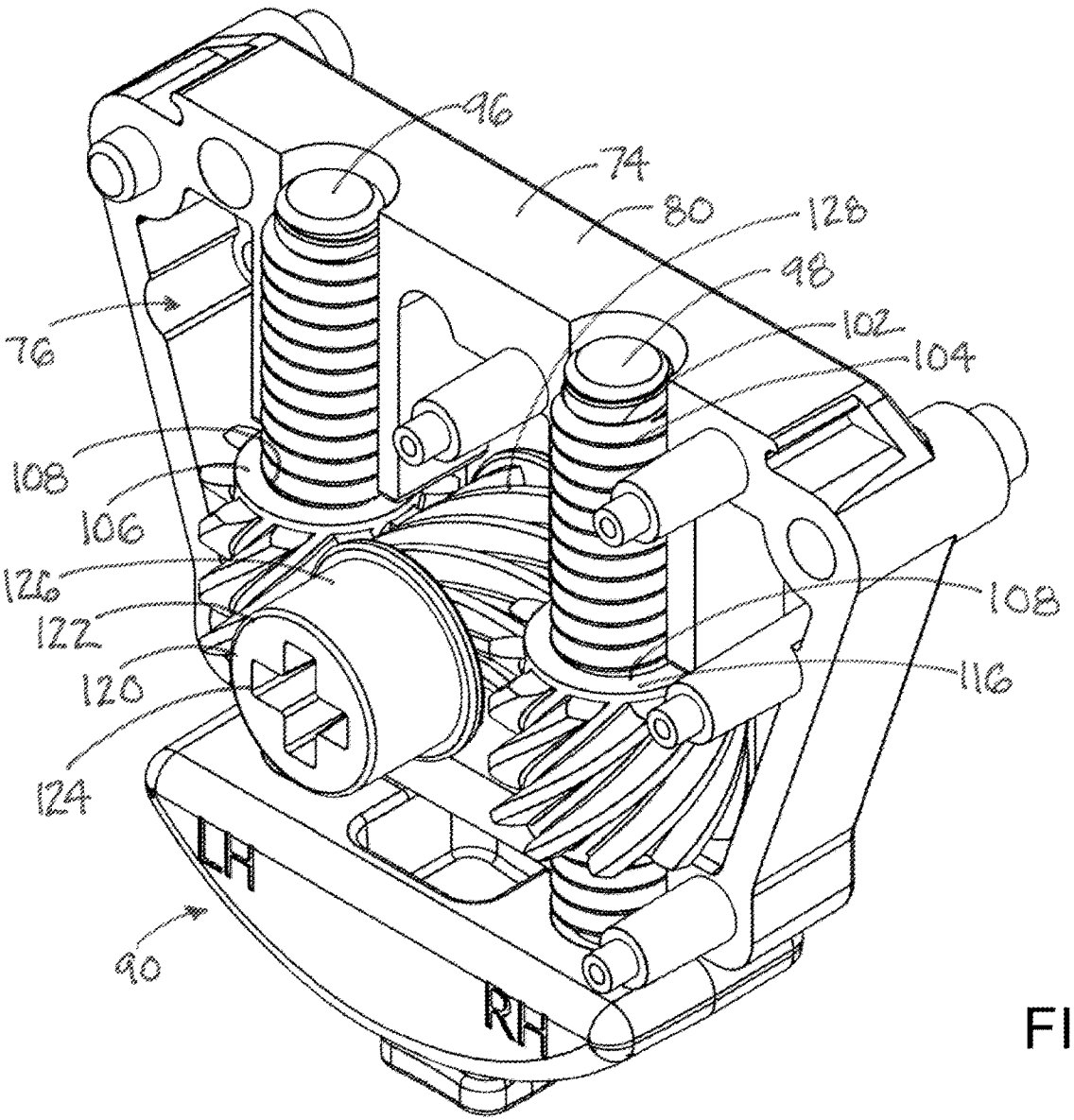
FIG. 13 is a schematic perspective view of another illustrative embodiment of the adjustment assembly isolated from other elements of the system, with a shell portion of the case of the adjustment assembly removed to reveal detail, according to an illustrative embodiment.
Figure 14:
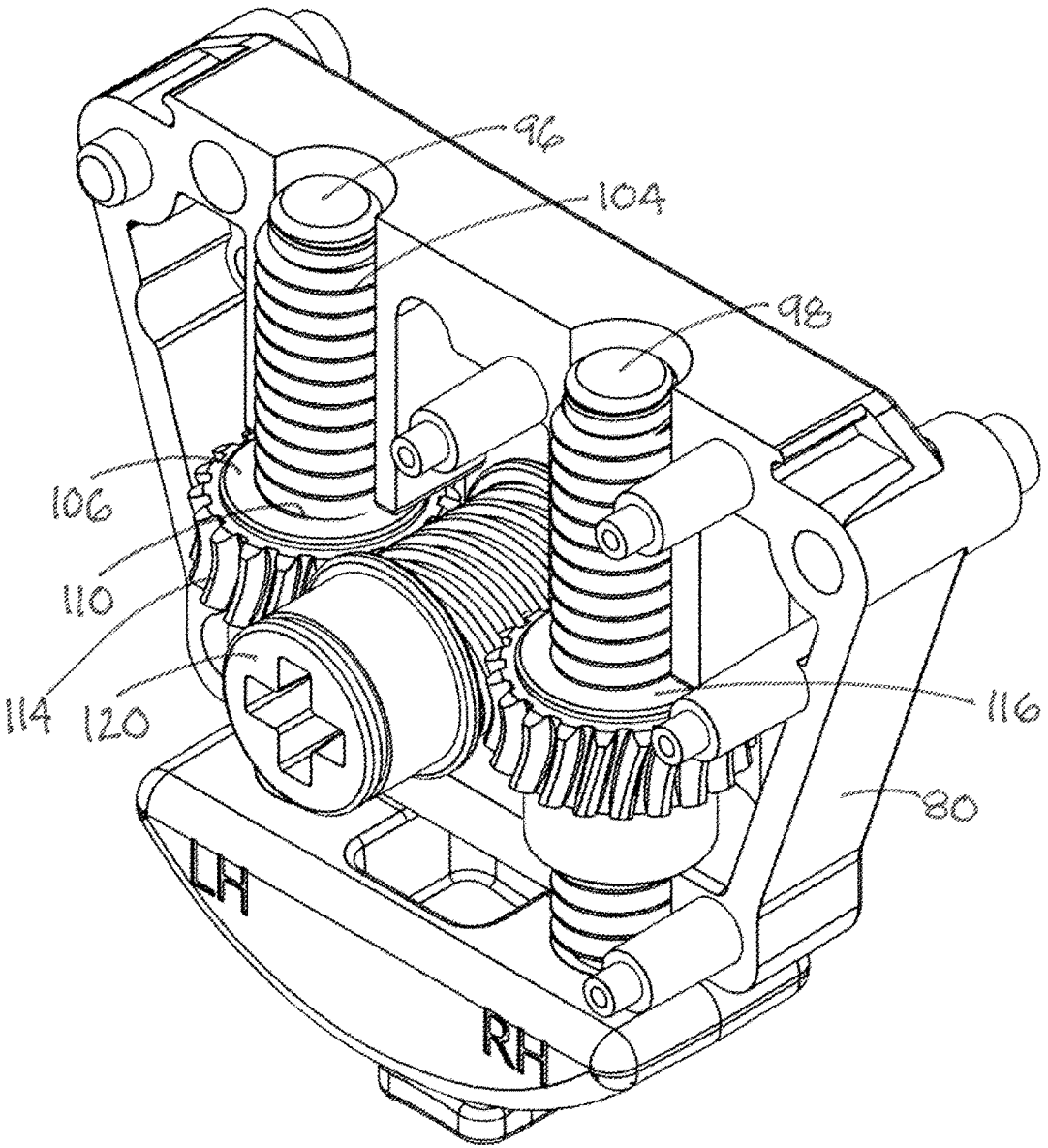
FIG. 14 is a schematic perspective view of still another illustrative embodiment of the adjustment assembly isolated from other elements of the system, with a shell portion of the case of the adjustment assembly removed to reveal detail, according to an illustrative embodiment.
Figure 15:
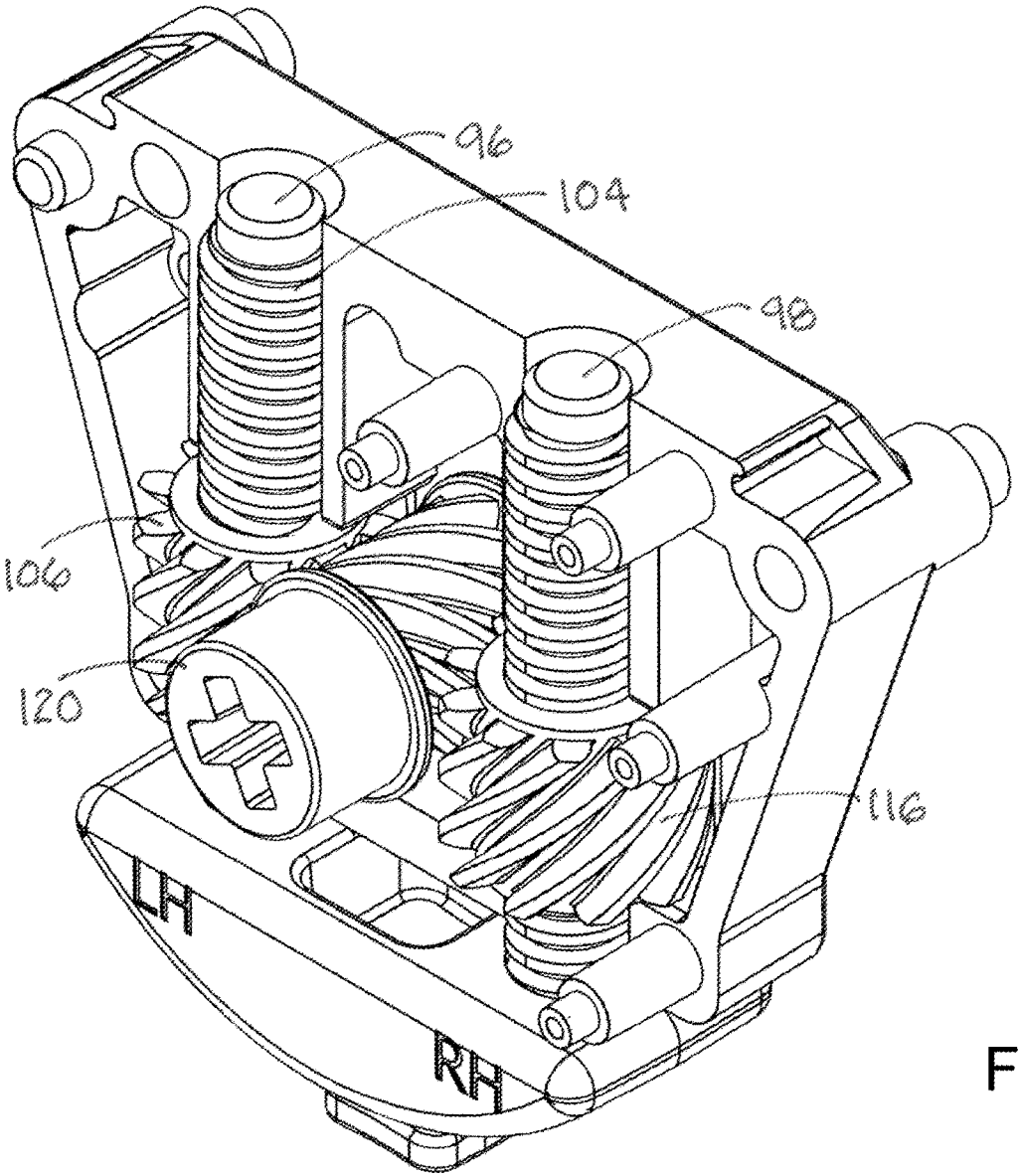
FIG. 15 is a schematic perspective view of yet another illustrative embodiment of the adjustment assembly isolated from other elements of the system, with a shell portion of the case of the adjustment assembly removed to reveal detail, according to an illustrative embodiment.
Figure 16:
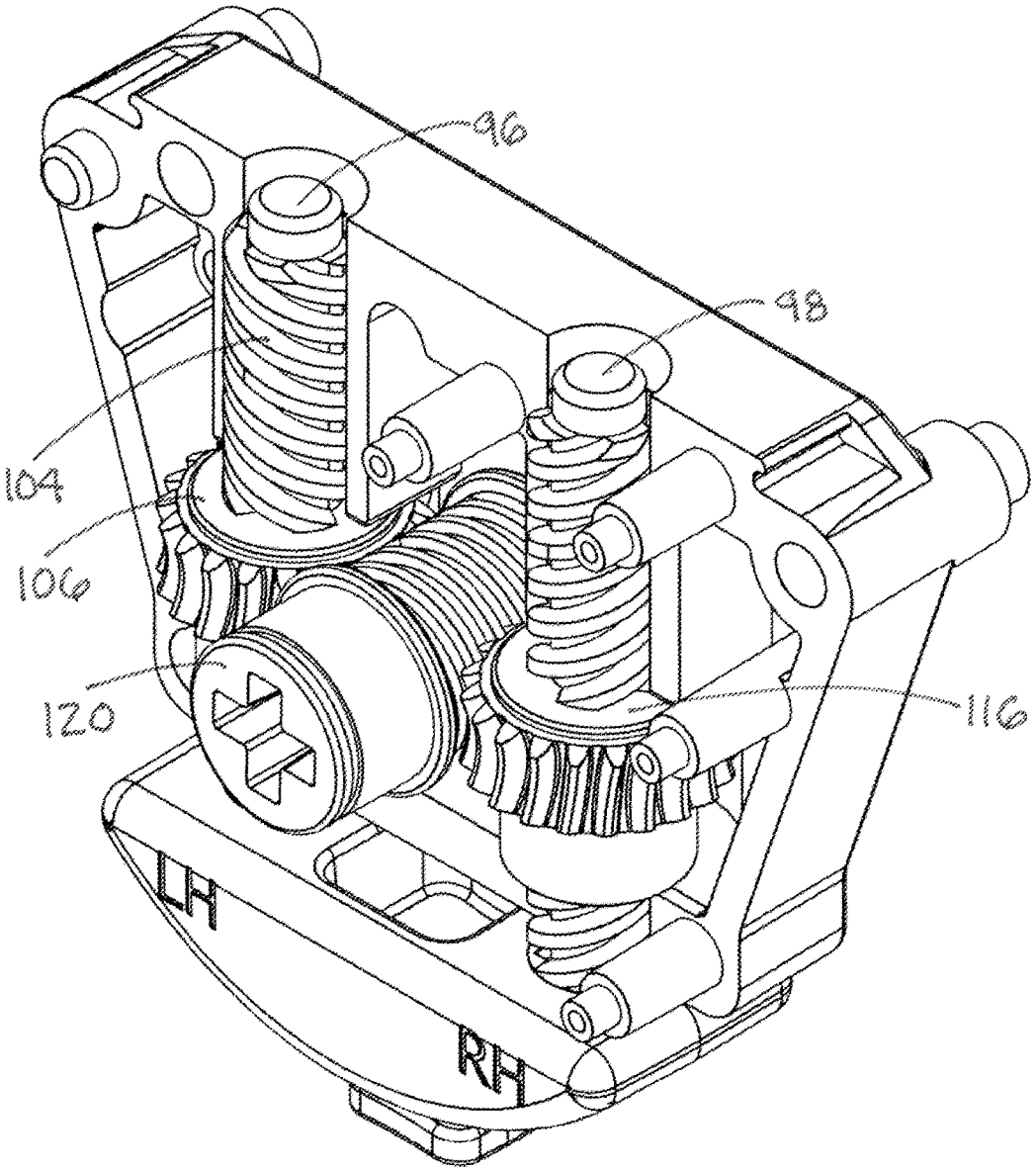
FIG. 16 is a schematic perspective view of still yet another illustrative embodiment of the adjustment assembly isolated from other elements of the system, with a shell portion of the case of the adjustment assembly removed to reveal detail, according to an illustrative embodiment.
Figure 17:
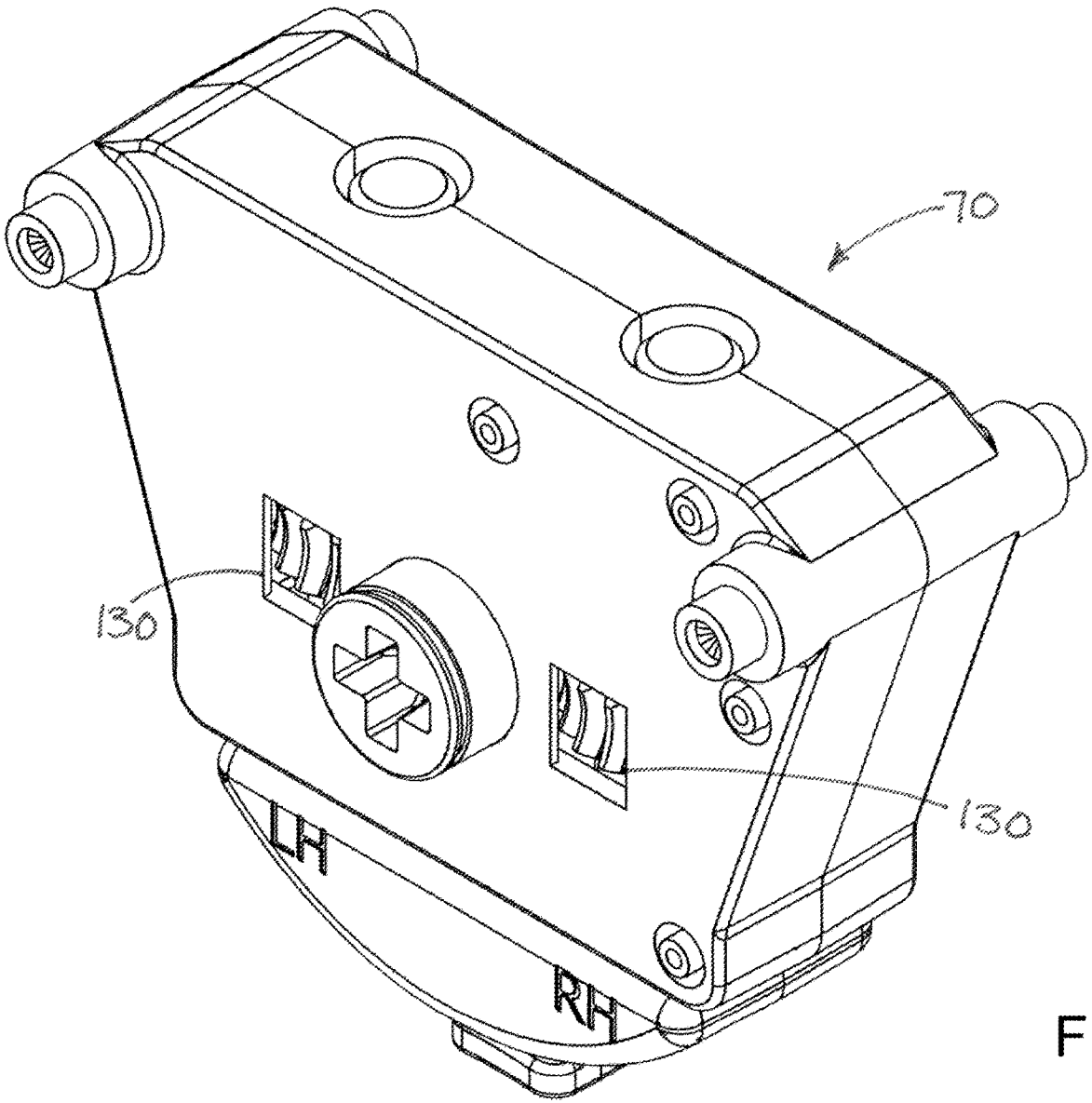
FIG. 17 is a schematic perspective view of an illustrative embodiment of the adjustment assembly with clearance windows formed in one of the shell portions of the case of the adjustment assembly, according to an illustrative embodiment.
Figure 18:
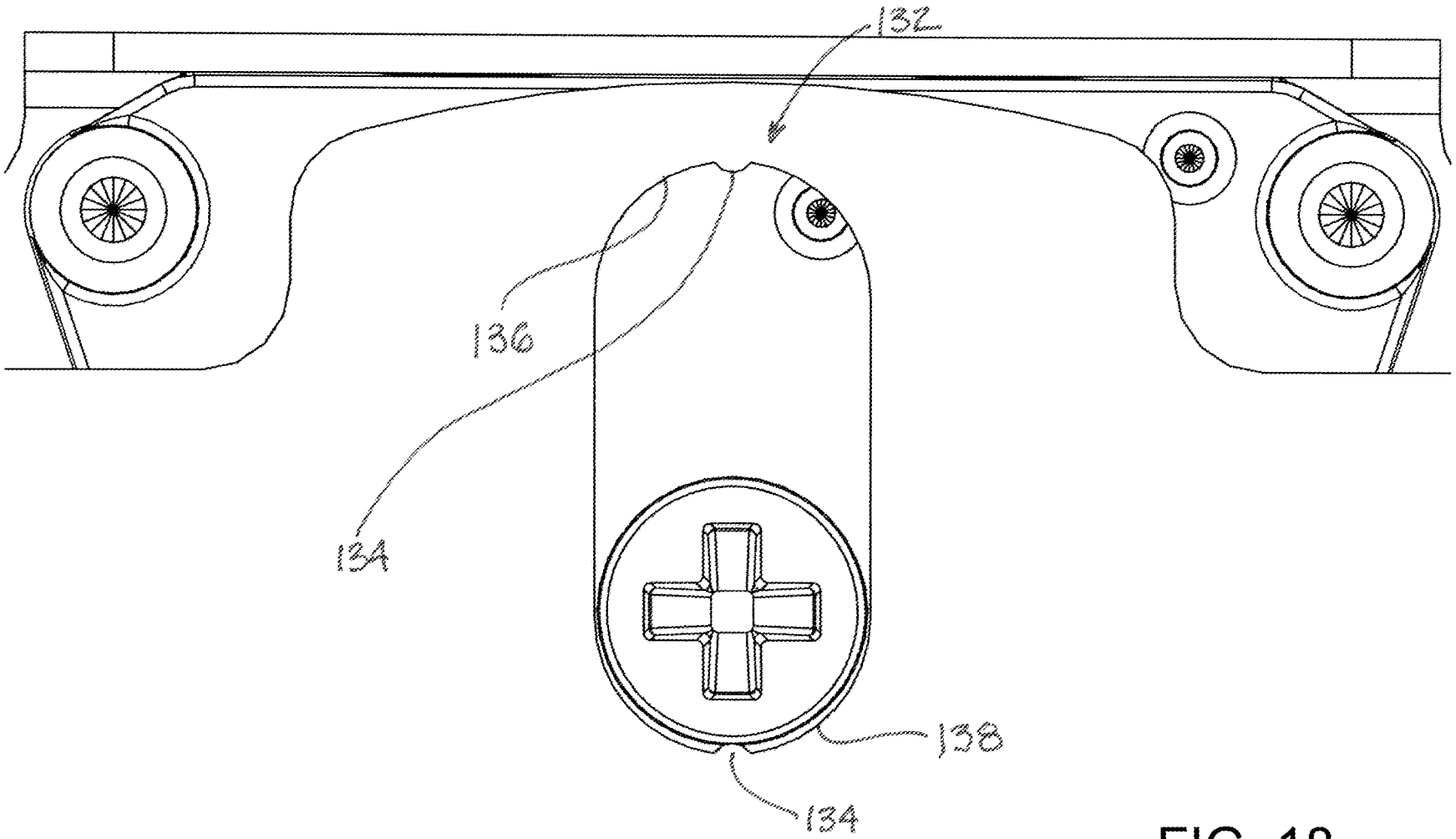
FIG. 18 is a schematic side view of a portion of an adjustment assembly with an illustrative example of an abuse indicating structure including protrusions which provide abuse indicators.

The adjustment assembly 70 may further comprise at least one adjustment gear 106 positioned about one of the adjustment posts 96 (such as shown in FIGS. 12 and 13). In embodiments such as shown in FIGS. 8 through 10 and 13 through 16, a pair of the adjustment gears 106, 116 may each be positioned about one of the respective adjustment posts 96, 98. The adjustment gear 106 may be engaged with the peripheral surface 102 of the post 96, and may be rotatable with respect to the adjustment post 96, such as about a substantially vertical axis, when the support mechanism 10 is oriented for use in a door panel.

The adjustment gear 106 may have an interior surface 108 positioned adjacent to the peripheral surface 102 of the adjustment post 96. Similarly, the interior surface of adjustment gear 116 may be positioned adjacent to peripheral surface of the adjustment post 98. Threads 110 may be formed on at least a portion of the interior surface 108 of the adjustment gear 106 or gears 106, 116, and the threads 110 may cooperatively engage the threads 104 of the adjustment post. The adjustment gears 106, 116 may each have an exterior surface 112 positioned opposite of the interior surface 108 of the respective gear, and threads 114 may be formed on at least a portion of the respective exterior surfaces 112 of the gears 106.

The adjustment element 90 may include an adjustment screw 120 which engages the adjustment gear 106 or gears 106, 116 in a manner such that rotation of the adjustment screw causes rotation of the adjustment gear. The adjustment screw 120 may be rotatably supported on the case 72.

In embodiments such as shown in FIGS. 8 through 10 and 13 through 16, the adjustment screw 120 may be positioned between the pair of adjustment gears 106, 116 positioned on the pair of adjustment posts 96, 98 such that the threads on the adjustment screw simultaneously engage threads on both adjustment gears. The adjustment screw 120 may be rotatable about a substantially horizontal axis when the support mechanism 10 is oriented for use. The adjustment screw 120 may have an accessible end 122 which is accessible from the exterior of the mechanism 10. Illustratively, the end 122 may be accessible through the adjustment clearance opening 36 of the housing, and also may be accessible through the adjustment clearance slot 56 of the carriage plate, and further may be accessible through the adjustment clearance aperture 82 of one (or both) (or both of the shell portions. The accessible end 122 may have a tool engagement feature 124 which is configured to be engaged by a tool to facilitate rotation of the adjustment screw 120 using the tool. In some embodiments, a pair of opposite accessible ends of the adjustment screw may be provided and may be accessible through various adjustment clearance features of the housing 20, the carriage plates 52, 54, and the shell portions 78, 80 of the case 72. Illustratively, the tool engagement feature 124 may be a depression or cutout in the surface of the end 122 in the form of a straight slot or cross slot, but may also form a cavity for accepting, for example, a hex shaped tool end.

Further, the adjustment screw 120 has an outer surface an outer surface 126, and threads 128 may be formed on at least a portion of the outer surface. The threads 128 on the adjustment screw 120 may cooperatively engage the threads 114 on the exterior surface 112 of the adjustment gear or gears 106, 116.

Figure 11:
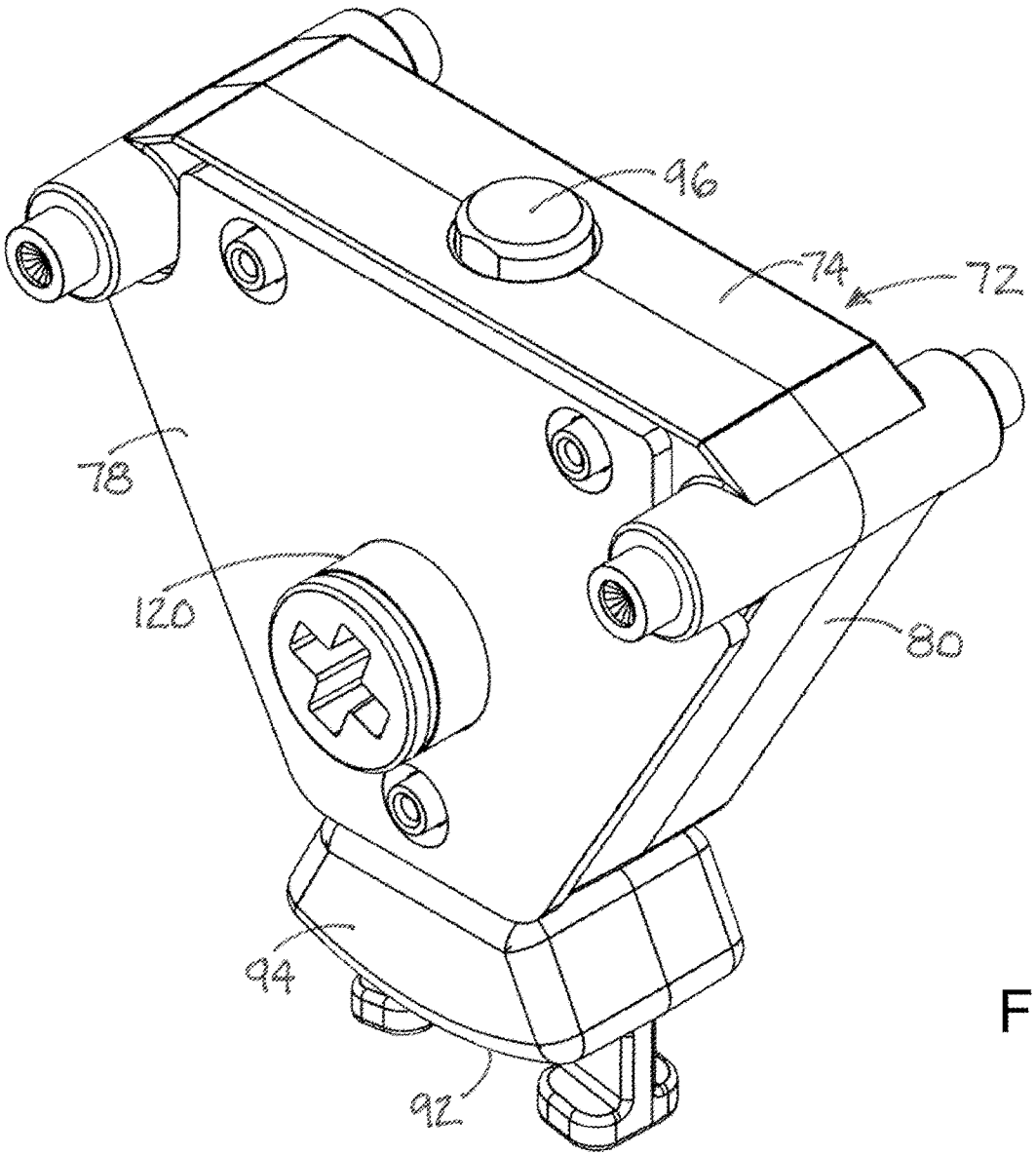
FIG. 11 is a schematic perspective view of another illustrative embodiment of the adjustment assembly isolated from other elements of the system.

In operation of the mechanism 10, such as embodiments shown in FIGS. 11 and 12, rotation of the adjustment screw 120 in a first rotational (e.g., clockwise) direction of the adjustment screw may rotate the adjustment gear 106 in a first rotational direction of the adjustment gear, and in turn may translate the adjustment post 96 of the adjustment element in a first direction with respect to the case (such as a downward direction) which effectively moves the case 72 in a second (and opposite) direction (such as an upward direction) with respect to the adjustment post 96. Such operation may effectively cause the rollers 64, 66 to move outwardly (and downwardly) with respect to the door panel to effectively raise the door panel with respect to the threshold or sill of the opening.

Conversely, in operation of mechanisms such as illustrated in FIGS. 11 and 12, rotation of the adjustment screw 120 in a second rotational (e.g., counterclockwise) direction of the adjustment screw rotates the adjustment gear 106 in a second rotational direction of the adjustment gear, and in turn may translate the adjustment post 96 in the second (e.g., upward) direction with respect to the case 72 which effectively moves the case in the first (downward) direction with respect to the adjustment post 96. Such operation may effectively cause the rollers 64, 66 to move inwardly (and upwardly) with respect to the door panel to effectively lower the door panel with respect to the threshold or sill of the opening.

In operation of mechanisms 10 such as shown in the embodiments of FIGS. 13 through 16, rotation of the adjustment screw 120 in the first rotational (e.g., clockwise) direction of the adjustment screw may rotate a first one 106 of the adjustment gears in a first rotational (e.g., counterclockwise) direction of the first adjustment gear and may rotate a second one 116 of the adjustment gears in a first rotational (e.g., clockwise) direction of the second adjustment gear, and in turn both a first one 96 and a second one 98 of the adjustment posts may translate in the first direction with respect to the case (such as the downward direction) which effectively moves the case 72 in the second (and opposite) direction (such as an upward direction) with respect to the adjustment post 96. The first rotational direction of the first adjustment gear 106 may be opposite of the first rotational direction of the second adjustment gear 116. Such operation may effectively cause the rollers 64, 66 to move outwardly (and downwardly) with respect to the door panel to effectively raise the door panel with respect to the threshold or sill of the opening.

In operation of mechanisms such as shown in FIGS. 13 through 16, rotation of the adjustment screw 120 in the second rotational (e.g., counterclockwise) direction of the adjustment screw may rotate the first adjustment gear 106 in the second rotational (e.g., clockwise) direction of the first adjustment gear and may rotate the second adjustment gear 116 in the second rotational (e.g., counterclockwise) direction of the second adjustment gear, and in turn both the first adjustment post 96 and the second adjustment post 98 may translate in the second (e.g., upward) direction with respect to the case 72, which may effectively move the case in the first (e.g., downward) direction. Again, the second rotational direction of the first adjustment gear 96 may be opposite to the second rotational direction of the second adjustment gear 98. Such operation may effectively cause the rollers 64, 66 to move inwardly (and upwardly) with respect to the door panel to effectively lower the door panel with respect to the threshold or sill of the opening.

In a broad sense, the roller support mechanism 10 has a stationary portion and a movable portion, relative to the door panel 2, with the stationary portion including the housing 20 and the adjustment assembly 70 and the movable portion including the roller carriage 50 and the rollers 64, 66. Operation of the adjustment assembly 70 effectively adjusts the position of the movable portion with respect to the position of the stationary portion to raise and/or lower a door panel on which the mechanism 10 is mounted with respect to elements of the opening in which the door assembly is positioned.

Optionally, some embodiments of the roller support mechanism 10 may include a case 72 in which at least one of the shell portions 78, 80 of the case of the adjustment assembly has one or more clearance window 130 formed therein to provide further or additional physical space clearance for portions of one or more of the adjustment gears 106, 116 to permit a relatively thinner or smaller lateral width of the shell portions of the case 72, which in turn may permit a thinner lateral thickness of the housing 20.

In optional embodiments, modifications of the aforementioned structures, or additional structures, may be utilized to provide an abuse indicating structure to supply an indication or evidence of abusive adjustment of the adjustment assembly 70, or adjustment operation of the assembly 70 which exceeds parameters for which the mechanism is designed. For example, as illustratively shown in FIG. 18, an abuse indicator 132 may be utilized on the support mechanism 10. Illustratively, the abuse indicator 132 may comprise a protrusion 134 on the carriage plate 52 which protrudes into the adjustment clearance slot 56 of the carriage plate. The protrusion 134 may be positioned with respect to the adjustment clearance slot 56 such that adjustment of the adjustment assembly 70 to at least one extreme adjustment position results in contact between the adjustment screw 120 and the protrusion 134 and may produce a marking or other indicator of contact on the adjustment screw or on the protrusion, or both. An illustrative adjustment clearance slot 56 is elongated with opposite end edges 136, 138 which may be relatively semicircular in shape. The protrusion 134 may protrude from at least one of the end edges 136, and a protrusion may protrude from each of the opposite end edges 136, 138 to provide an indication of adjustment of the adjustment screw 120 to either of two extreme adjustment positions of the clearance slot 56.

Figure 19:
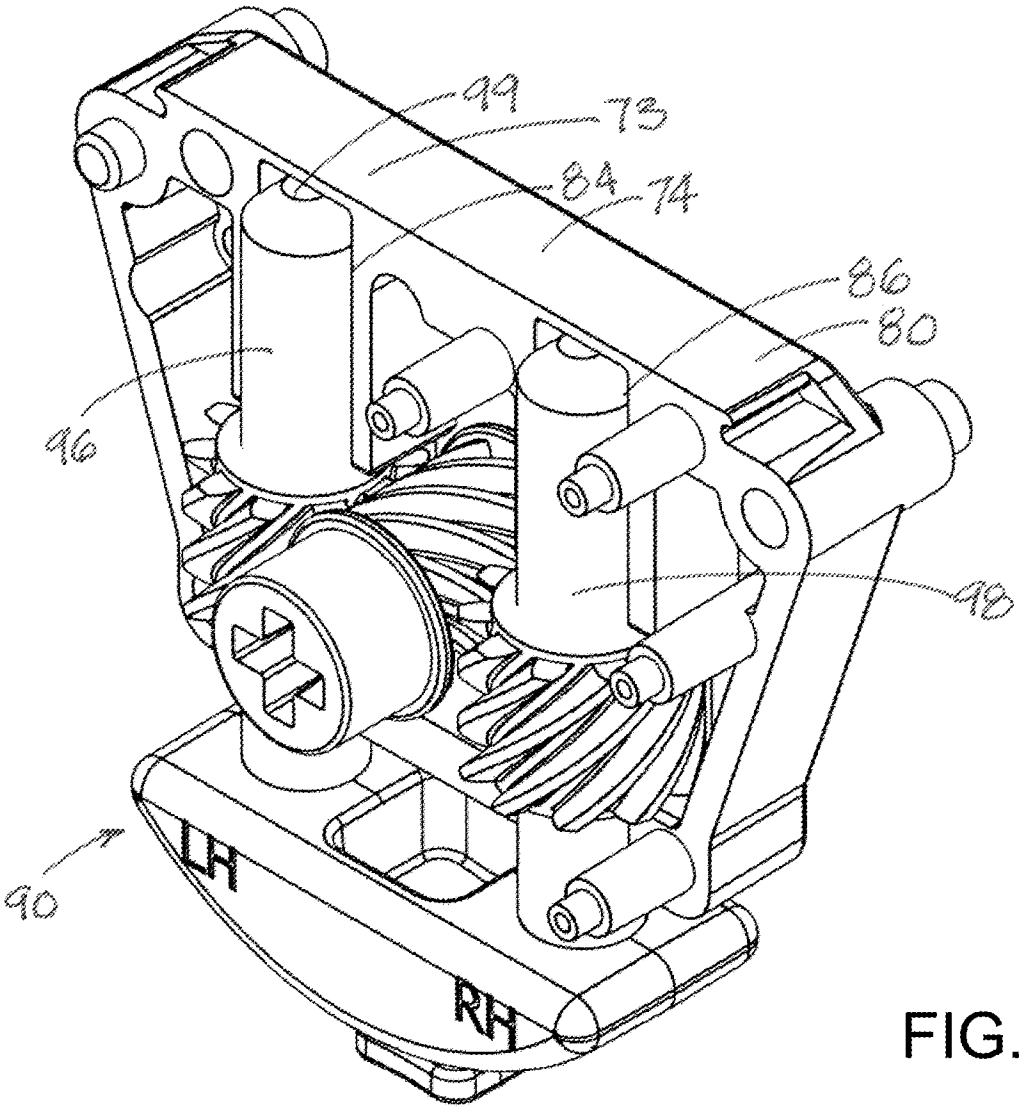
FIG. 19 is a schematic perspective view of an embodiment of the adjustment assembly having another illustrative example of an abuse indicating structure, according to an illustrative embodiment.
Figure 20:
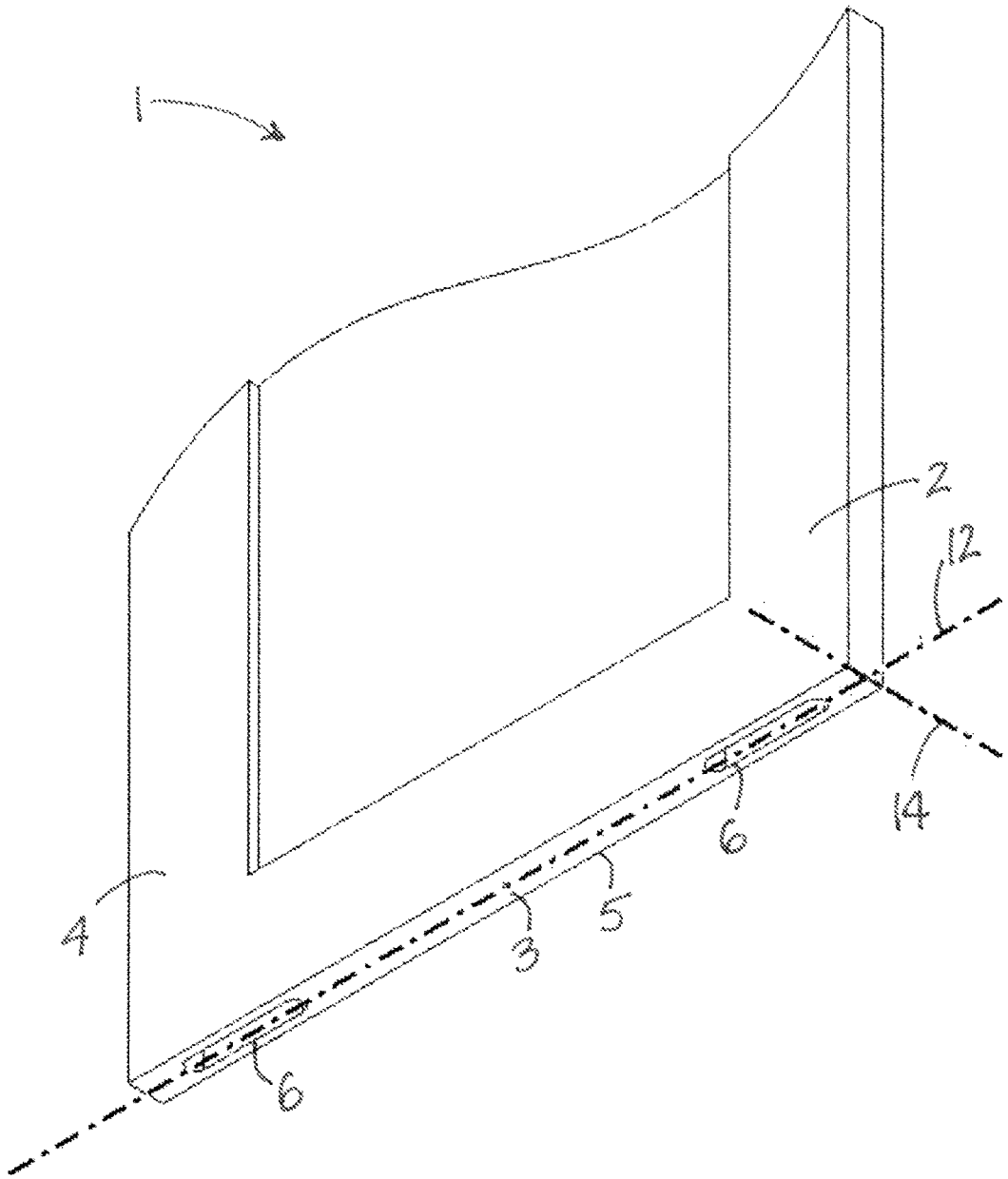
FIG. 20 is a schematic perspective view of a lower portion of the door assembly showing positions of the roller support mechanisms on the door panel, according to an illustrative embodiment.
Figure 21:
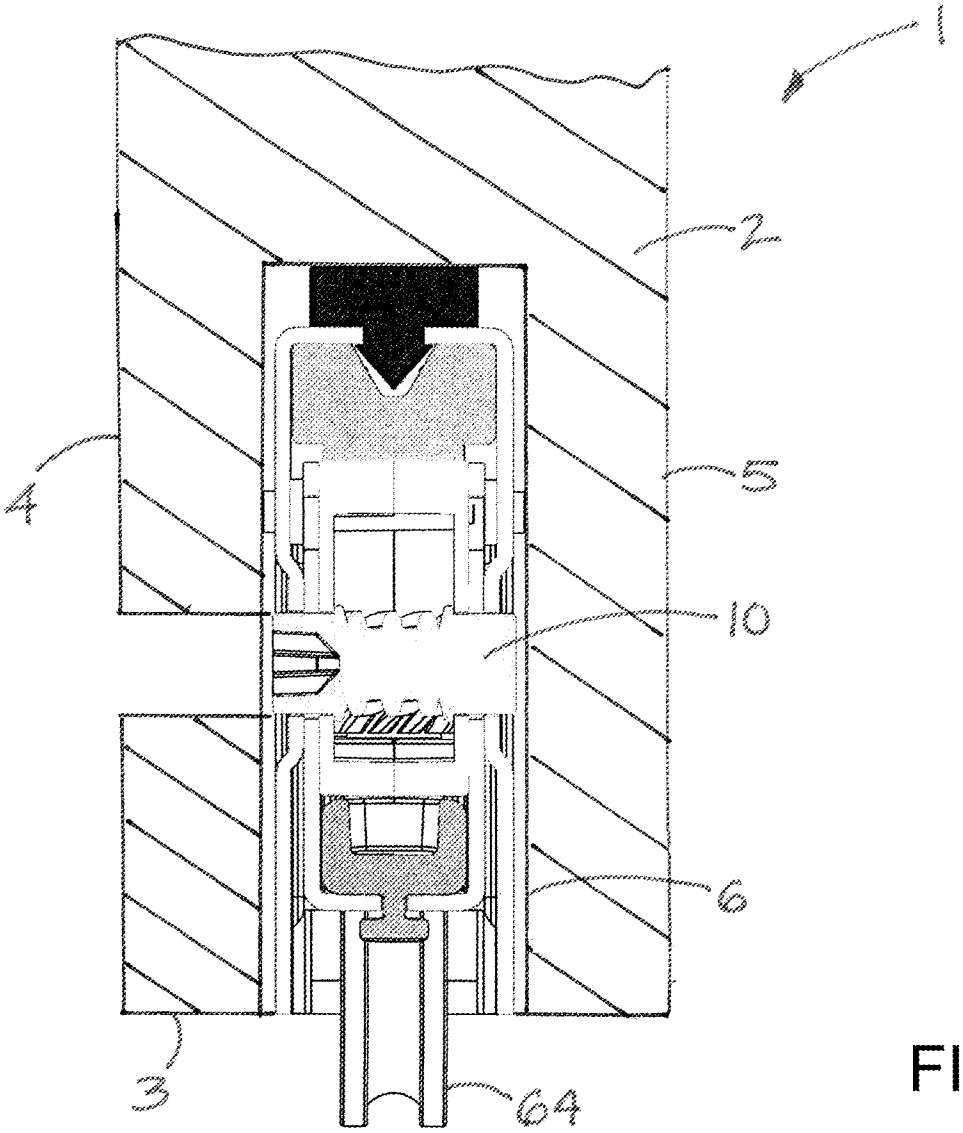
FIG. 21 is a schematic sectional view of a lower portion of the door assembly showing the roller support mechanism positioned in the roller cavity of the door panel, according to an illustrative embodiment.

Another illustrative abuse indicating structure which may be implemented is shown in FIG. 19, which utilizes the one (or more) of the adjustment posts 96, 98 of the adjustment element to provide an indication of an attempt to adjust the adjustment assembly 70 beyond the normal or acceptable range of adjustment. In the illustrative embodiment, at least one of the adjustment post 96, 98 has an upper end 99 which is configured to be driven against, and puncture or otherwise damage, the upper case wall 73 of the case 72 when adjustment of the adjustment screw 120 exceeds the normal range of adjustment and, as a result, the post or posts are translated (rather than simply rotated) in the respective sleeve surfaces 84, 86. Optionally, the upper end 99 of one or both the posts may have a tapered shape to facilitate fracture of the upper case wall 73 when translational movement of the post occurs.

Any suitable type of threads, or combinations of threads, may be employed on the adjustment posts, the interior and exterior of the adjustment gear or gears, and the adjustment screw, including, for example, V-threads and acme threads.

Further, gear drive styles such as bevel, spiral bevel, hypoid, and other styles may be utilized.

The range of adjustment, from the least or lowest door panel position on the rollers, to the greatest or highest door panel position, may be suitable to the application and illustratively may be approximately 0.40 inches from the least to the greatest adjustment positions, although other ranges that are larger and smaller may be used. Further, various suitable pitch dimensions and gear ratios may be utilized. The number of rotations of the adjustment screw to move through the full range of height adjustment utilized may also vary, and illustratively may be as low as approximately 8 turns (or even fewer turns) to approximately 80 turns (or even more turns). One highly useful embodiment utilizes 10 turns of the adjustment screw to move through substantially the entire range of adjustment.

Physical dimensions of the support mechanism may also be sized to be suitable to the door panel application, including the dimensions of the housing 20, the rollers 64, 66; and the case 72 of the adjustment assembly.

Embodiments having additional exemplary variations of the disclosure are shown in FIGS. 23 through 26, and such embodiments may be highly useful for engaging the hinges between panels or leaves of a folding door closure of an opening in a building structure. In such embodiments, the relative positioning of portions of the adjustment element 142 and the case may be different than other embodiments of the disclosure. For example, the position of the contact component 144 of the adjustment element relative to the adjustment post or posts 146 may be altered from an inferior position of the component 144 relative to the posts 146 to a superior position of the component relative to the posts. Similarly, the contact component 144 may be in a superior position with respect to the case 148 rather than being in an inferior position to the case.

The embodiments shown in FIGS. 23 through 26 also illustrate a variation of the disclosure in which rollers 150 are directly mounted on the case 148 via, for example, axles 152 extending outwardly from sides of the case, and thus do not utilize a carriage movable within a housing. The exemplary embodiments also illustrate the use of four rollers mounted on the case with a pair of the rollers positioned on each side of the case. Optionally, additional rollers mounted to rotate about axes oriented perpendicular to the rollers 150 to help guide movement of the mechanism along a track position along portions of the perimeter of the opening in the building structure.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. An adjustable roller support mechanism for mounting on a panel positionable with respect to an opening in a building structure to support the panel on the structure, the roller support mechanism comprising:

an adjustment assembly configured to be mounted on the panel, the adjustment assembly comprising:

a case defining an interior and having a contact surface;

at least one roller for contacting the opening rotatably mounted on the case; and an adjustment element configured to contact the panel through the contact surface of the case, the adjustment element being further configured to adjustably move the case and the at least one roller mounted thereon with respect to the contact surface to adjust the position of the at least one roller with respect to the panel when the adjustment assembly is mounted on the panel;

wherein the adjustment element includes:

a contact component having the contact surface thereon;

at least one adjustment post at least partially positioned in the interior of the case and having an end joined to the contact bumper such that movement of the at least one adjustment post with respect to the case is communicated to a contact bumper having the contact surface thereon; and wherein the at least one adjustment post is adjustably extendable from the interior of the case to adjust the position of the contact surface with respect to the at least one roller mounted on the case;

wherein the adjustment element further includes at least one adjustment gear positioned about the at least one adjustment post and being rotatable with respect to the at least one adjustment post, the at least one adjustment gear being engaged with the peripheral surface of the at least one adjustment post in a manner such that rotation of the adjustment gear adjust a degree of extension of the adjustment post from the interior of the case.

2. The mechanism of claim 1 wherein the at least one adjustment post has a peripheral surface, at least a portion of the peripheral surface having threads formed thereon, wherein the at least one adjustment gear has an interior surface positioned adjacent to the peripheral surface of the at least one adjustment post, threads being formed on at least a portion of the interior surface of the at least one adjustment gear which cooperatively engage the threads of the at least one adjustment post such that rotation of the at least one adjustment gear causes translational movement of the at least one adjustment post.

3. The mechanism of claim 1 wherein the adjustment element includes:

an adjustment screw rotatably supported on the case and engaging the at least one adjustment gear in a manner such that rotation of the adjustment screw causes rotation of the at least one adjustment gear.

4. The mechanism of claim 3 wherein the at least one adjustment gear has an exterior surface positioned opposite of the interior surface of the adjustment gear, threads being formed on at least a portion of the exterior surface of the at least one adjustment gear; and wherein the adjustment screw of the adjustment element has an outer surface, threads being formed on at least a portion of the outer surface of the adjustment screw, the threads cooperatively engaging the threads on the exterior surface of the at least one adjustment gear.

5. The mechanism of claim 3 wherein the adjustment screw has an accessible end which is accessible from an exterior of the case, the accessible end having a tool engagement feature configured to be engaged by a tool.

6. An adjustable roller support mechanism for mounting on a panel positionable with respect to an opening in a building structure to support the panel on the structure, the roller support mechanism comprising:

an adjustment assembly configured to be mounted on the panel, the adjustment assembly comprising:

a case defining an interior and having a contact surface;

at least one roller for contacting the opening rotatably mounted on the case; and an adjustment element configured to contact the panel through the contact surface of the case, the adjustment element being further configured to adjustably move the case and the at least one roller mounted thereon with respect to the contact surface to adjust the position of the at least one roller with respect to the panel when the adjustment assembly is mounted on the panel;

wherein the adjustment element includes:

a contact component having the contact surface thereon;

at least one adjustment post at least partially positioned in the interior of the case and having an end joined to the contact bumper such that movement of the at least one adjustment post with respect to the case is communicated to a contact bumper having the contact surface thereon; and wherein the at least one adjustment post is adjustably extendable from the interior of the case to adjust the position of the contact surface with respect to the at least one roller mounted on the case;

wherein the at least one adjustment post includes a pair of the adjustment posts, the ends of the adjustment posts being joined to the contact bumper; and wherein the at least one adjustment gear includes a pair of adjustment gears with each of the adjustment gears being positioned about one of the adjustment posts of the pair of adjustment posts.

7. The mechanism of claim 6 wherein the adjustment element includes:

an adjustment screw rotatably supported on the case, the adjustment screw being positioned between the pair of adjustment posts and being engaged with each of the adjustment gears on the pair of adjustment posts such that threads on the adjustment screw simultaneously engage threads on each adjustment gear.

8. An adjustable roller support mechanism positionable in a roller cavity of a sliding glazed panel, the roller support mechanism comprising:

a housing defining an interior space and including an upper bearing structure for bearing against a portion of the panel when mounted on the panel, a roller carriage positioned in the interior space of the housing and being movable with respect to the housing;

at least one roller mounted on the roller carriage in a manner permitting rotation of the roller with respect to the roller carriage;

an adjustment assembly configured to adjust a position of the roller carriage with respect to the housing in the interior space of the housing, the adjustment assembly comprising:

a case mounted on the housing such that the case and the housing move as a unit; and an adjustment element movable with respect to the case to bear against the roller carriage to move the roller carriage and the at least one roller mounted thereon with respect to the housing.

9. The mechanism of claim 8 wherein the roller support mechanism has a stationary portion and a movable portion, the stationary portion including the housing and the adjustment assembly, the movable portion including the roller carriage and the at least one roller, the adjustment assembly being configured to adjust a position of the movable portion with respect to the stationary portion.

10. The mechanism of claim 8 wherein the adjustment element includes:

a contact bumper having the contact surface thereon;

at least one adjustment post at least partially positioned in an interior of the case and having an end joined to the contact bumper such that movement of the at least one adjustment post with respect to the case is communicated to the contact bumper; and wherein the at least one adjustment post is adjustably extendable from the interior of the case to adjust the position of the contact surface with respect to the at least one roller on the roller carriage.

11. The mechanism of claim 10 wherein the adjustment element includes:

at least one adjustment gear positioned about the at least one adjustment post and being rotatable with respect to the at least one adjustment post, the at least one adjustment gear being engaged with the peripheral surface of the at least one adjustment post in a manner such that rotation of the adjustment gear adjust a degree of extension of the adjustment post from the interior of the case.

12. The mechanism of claim 11 wherein the at least one adjustment post has a peripheral surface, at least a portion of the peripheral surface having threads formed thereon, wherein the at least one adjustment gear has an interior surface positioned adjacent to the peripheral surface of the at least one adjustment post, threads being formed on at least a portion of the interior surface of the at least one adjustment gear which cooperatively engage the threads of the at least one adjustment post such that rotation of the at least one adjustment gear causes translational movement of the at least one adjustment post.

13. The mechanism of claim 11 wherein the adjustment element includes:

an adjustment screw rotatably supported on the case and engaging the at least one adjustment gear in a manner such that rotation of the adjustment screw causes rotation of the at least one adjustment gear.

14. The mechanism of claim 13 wherein the at least one adjustment gear has an exterior surface positioned opposite of the interior surface of the adjustment gear, threads being formed on at least a portion of the exterior surface of the at least one adjustment gear; and wherein the adjustment screw of the adjustment element has an outer surface, threads being formed on at least a portion of the outer surface of the adjustment screw, the threads cooperatively engaging the threads on the exterior surface of the at least one adjustment gear.

15. The mechanism of claim 13 wherein the roller carriage includes:

a pair of carriage plates at least partially positioned in the interior space of the housing;

at least one carriage axle extending between the carriage plates, the at least one roller being mounted on the at least one carriage axle; and wherein at least one of the carriage plates has an adjustment clearance slot through which a portion of the adjustment screw extends; and an abuse indicator configured to provide evidence of abusive adjustment of the adjustment assembly, the abuse indicator comprising a protrusion on the at least one carriage plate protruding into the adjustment clearance slot of the carriage plate and being positioned with respect to the adjustment clearance slot such that adjustment of the adjustment assembly to at least one extreme adjustment position results in contact between the adjustment screw and the protrusion and produces a marking on the adjustment screw.

16. The mechanism of claim 8 wherein the at least one roller comprises a pair of rollers; and wherein the roller carriage includes:

a pair of carriage plates at least partially positioned in the interior space of the housing; and a pair of carriage axles extending between the carriage plates, each of the rollers being mounted on one of the carriage axles.

* * * * *